US008359814B2

(12) United States Patent
Williams

(10) Patent No.: US 8,359,814 B2
(45) Date of Patent: Jan. 29, 2013

(54) PULTRUDED/EXTRUDED UTILITY LIGHTING, MOUNTING AND CLIMBING STRUCTURES

(75) Inventor: Donald S. Williams, Chicago, IL (US)

(73) Assignee: Duratel, Inc., Chicago, IL (US)

( * ) Notice: Subject to any disclaimer, the term of this patent is extended or adjusted under 35 U.S.C. 154(b) by 68 days.

(21) Appl. No.: 12/901,784

(22) Filed: Oct. 11, 2010

(65) Prior Publication Data

US 2011/0134653 A1 Jun. 9, 2011

Related U.S. Application Data

(63) Continuation-in-part of application No. 12/613,879, filed on Nov. 6, 2009, which is a continuation-in-part of application No. 11/803,977, filed on May 16, 2007, now Pat. No. 8,024,908.

(60) Provisional application No. 60/801,856, filed on May 18, 2006, provisional application No. 61/250,647, filed on Oct. 12, 2009, provisional application No. 61/250,658, filed on Oct. 12, 2009, provisional application No. 61/251,854, filed on Oct. 15, 2009, provisional application No. 61/305,598, filed on Feb. 18, 2010.

(51) Int. Cl.

| | |
|---|---|
| ***E04C 3/30*** | (2006.01) |
| *E04C 3/00* | (2006.01) |
| *E04H 12/02* | (2006.01) |

(52) U.S. Cl. ..... 52/843; 52/309.1; 52/651.02; 52/834; 52/852

(58) Field of Classification Search ..... 52/651.01, 52/651.07, 651.02, 852, 831, 834, 836, 843; D25/123, 125, 129

See application file for complete search history.

(56) References Cited

U.S. PATENT DOCUMENTS

| | | | | |
|---|---|---|---|---|
| 2,870,793 | A * | 1/1959 | Bailey | 138/141 |
| 3,270,480 | A * | 9/1966 | Beecker | 52/848 |
| 4,012,267 | A | 3/1977 | Klein | |
| 4,103,104 | A | 7/1978 | Spollen | |
| 4,438,430 | A | 3/1984 | Young | |
| 4,516,069 | A | 5/1985 | Schmanski | |
| 4,751,804 | A | 6/1988 | Cazaly | |
| 4,803,819 | A | 2/1989 | Kelsey | |
| 4,812,343 | A | 3/1989 | Kiekhaefer | |
| 4,941,763 | A | 7/1990 | Euteneuer | |
| 5,175,971 | A | 1/1993 | McCombs | |
| 5,207,850 | A | 5/1993 | Parekh | |
| 5,212,891 | A | 5/1993 | Schuermann | |
| 5,222,344 | A | 6/1993 | Johnson | |
| 5,263,296 | A | 11/1993 | Spera | |
| 5,354,607 | A | 10/1994 | Swift | |
| 5,361,855 | A | 11/1994 | Schuermann | |
| 5,457,288 | A | 10/1995 | Olsson | |

(Continued)

FOREIGN PATENT DOCUMENTS

| | | |
|---|---|---|
| CA | 1 250 757 | 3/1989 |
| DE | 295 00 479 U1 | 8/1995 |

(Continued)

OTHER PUBLICATIONS

International Preliminary Report on Patentability PCT/US2007/011,781 dated Nov. 27, 2008.

(Continued)

*Primary Examiner* — Brian Glessner
*Assistant Examiner* — Joseph J Sadlon
(74) *Attorney, Agent, or Firm* — Gordon & Rees LLP

(57) ABSTRACT

Pultruded and/or extruded lighting, mounting and climbing structures. The lighting structures comprise plural pullwound pultruded cylindrical structures and a mounting structure. The lighting structures also include plural types of climbing components.

20 Claims, 23 Drawing Sheets

U.S. PATENT DOCUMENTS

| | | | | |
|---|---|---|---|---|
| 5,465,929 | A | 11/1995 | Dooley | |
| 5,476,627 | A | 12/1995 | Black | |
| 5,513,477 | A | 5/1996 | Farber | |
| 5,585,155 | A | 12/1996 | Heikkila | |
| 5,650,224 | A | 7/1997 | March | |
| 5,658,307 | A | 8/1997 | Exconde | |
| 5,658,519 | A | 8/1997 | March | |
| 5,704,185 | A | 1/1998 | Lindsay | |
| 5,716,686 | A | 2/1998 | Black | |
| 5,718,669 | A | 2/1998 | Marble | |
| 5,870,877 | A | 2/1999 | Turner | |
| 5,890,333 | A | 4/1999 | Boroviak | |
| 5,899,423 | A | 5/1999 | Albertini | |
| 5,937,521 | A | 8/1999 | March | |
| D415,574 | S | 10/1999 | Shrira | |
| 5,971,508 | A | 10/1999 | Deimen | |
| 5,971,509 | A | 10/1999 | Deimen | |
| 5,972,275 | A | 10/1999 | Phelps | |
| 5,979,119 | A | 11/1999 | Trafton | |
| 5,999,677 | A | 12/1999 | Moncisvais | |
| 6,007,656 | A | 12/1999 | Heikkila | |
| 6,047,514 | A | 4/2000 | Verch | |
| 6,087,467 | A | 7/2000 | Marrocco, III | |
| 6,106,944 | A | 8/2000 | Heikkila | |
| 6,155,017 | A | 12/2000 | Turner | |
| D441,877 | S | 5/2001 | Fortier | |
| 6,286,281 | B1 * | 9/2001 | Johnson | 52/592.1 |
| 6,357,196 | B1 | 3/2002 | McCombs | |
| 6,367,215 | B1 | 4/2002 | Laing | |
| 6,400,873 | B1 | 6/2002 | Gimblet | |
| 6,453,635 | B1 | 9/2002 | Turner | |
| 6,513,234 | B2 | 2/2003 | Wilemon | |
| 6,564,960 | B1 * | 5/2003 | Grindstaff et al. | 220/4.31 |
| 6,568,072 | B2 | 5/2003 | Wilemon | |
| 6,627,704 | B2 | 9/2003 | Yeager | |
| 6,764,057 | B2 | 7/2004 | Fanucci | |
| 6,812,276 | B2 | 11/2004 | Yeager | |
| 6,834,469 | B2 | 12/2004 | Fingerson | |
| 6,897,382 | B2 | 5/2005 | Hager | |
| 6,993,802 | B1 | 2/2006 | Hone | |
| 7,063,096 | B2 | 6/2006 | Stoecker | |
| 7,116,282 | B2 | 10/2006 | Trankina | |
| 7,127,865 | B2 | 10/2006 | Douglas | |
| 7,200,973 | B2 | 4/2007 | Tunis | |
| 7,228,672 | B2 | 6/2007 | Hayes | |
| 7,578,245 | B2 | 8/2009 | Loines | |
| 8,101,107 | B2 * | 1/2012 | Brown et al. | 264/137 |
| 2001/0053820 | A1 | 12/2001 | Yeager | |
| 2002/0037409 | A1 | 3/2002 | Tunis | |
| 2002/0073915 | A1 | 6/2002 | Howard | |
| 2002/0095904 | A1 | 7/2002 | Fingerson | |
| 2003/0096123 | A1 | 5/2003 | Yeager | |
| 2004/0026112 | A1 | 2/2004 | Goldsworthy | |
| 2004/0050579 | A1 | 3/2004 | Hager | |
| 2004/0050580 | A1 | 3/2004 | Hager | |
| 2004/0050581 | A1 | 3/2004 | Hager | |
| 2004/0050584 | A1 | 3/2004 | Hager | |
| 2004/0065457 | A1 | 4/2004 | Hager | |
| 2004/0121137 | A1 | 6/2004 | Tunis | |
| 2004/0134162 | A1 | 7/2004 | Douglas | |
| 2005/0184206 | A1 | 8/2005 | Lepley | |
| 2005/0223673 | A1 | 10/2005 | Cadwell | |
| 2006/0123725 | A1 | 6/2006 | Godwin | |
| 2006/0150531 | A1 | 7/2006 | Cann | |
| 2006/0201081 | A1 | 9/2006 | Godwin | |
| 2006/0254167 | A1 | 11/2006 | Antonic | |
| 2006/0289189 | A1 | 12/2006 | Aisenbrey | |
| 2007/0013096 | A1 | 1/2007 | Rekret | |
| 2007/0107370 | A1 | 5/2007 | Douglas | |
| 2007/0113958 | A1 | 5/2007 | Brown | |
| 2007/0113983 | A1 | 5/2007 | Brown | |
| 2007/0116941 | A1 | 5/2007 | Brown | |
| 2007/0117921 | A1 | 5/2007 | Brown | |
| 2007/0209305 | A1 | 9/2007 | Douglas | |
| 2007/0223993 | A1 | 9/2007 | Peterson | |
| 2007/0252302 | A1 | 11/2007 | Hager | |
| 2007/0266670 | A1 | 11/2007 | Williams | |
| 2010/0064630 | A1 | 3/2010 | Williams | |

FOREIGN PATENT DOCUMENTS

| | | |
|---|---|---|
| WO | WO2006/0505235 | 5/2006 |

OTHER PUBLICATIONS

Pultusion Industry Council: Glossary of Terms; Copyright 2007—Pultrusion Industry Council http://www.cfa-hq.org/pic/products/glossary.htm.

* cited by examiner

FIG. 12 A
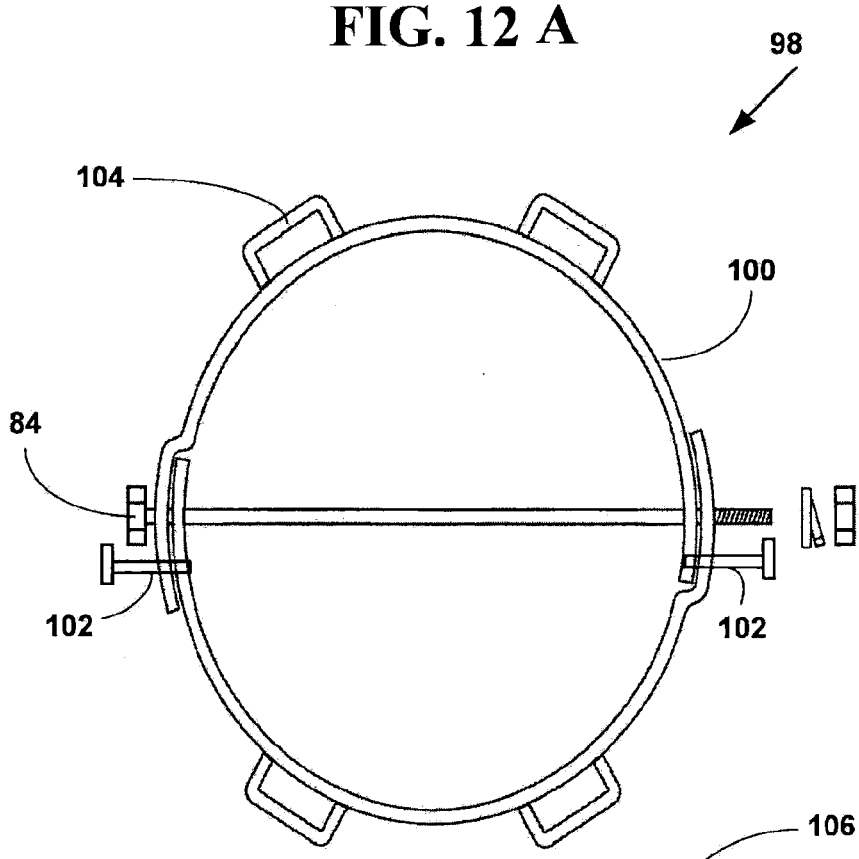
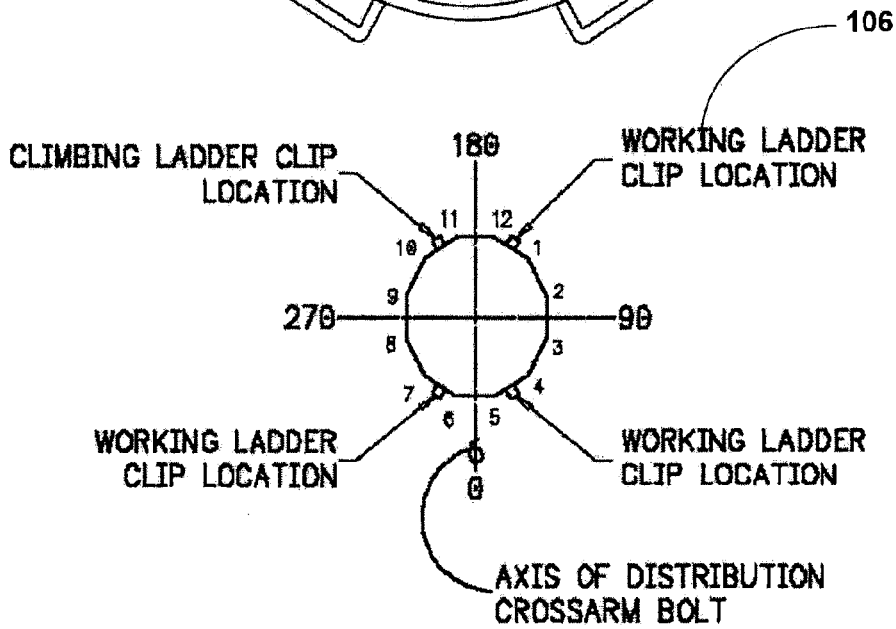
FIG. 12 B

FIG. 16A
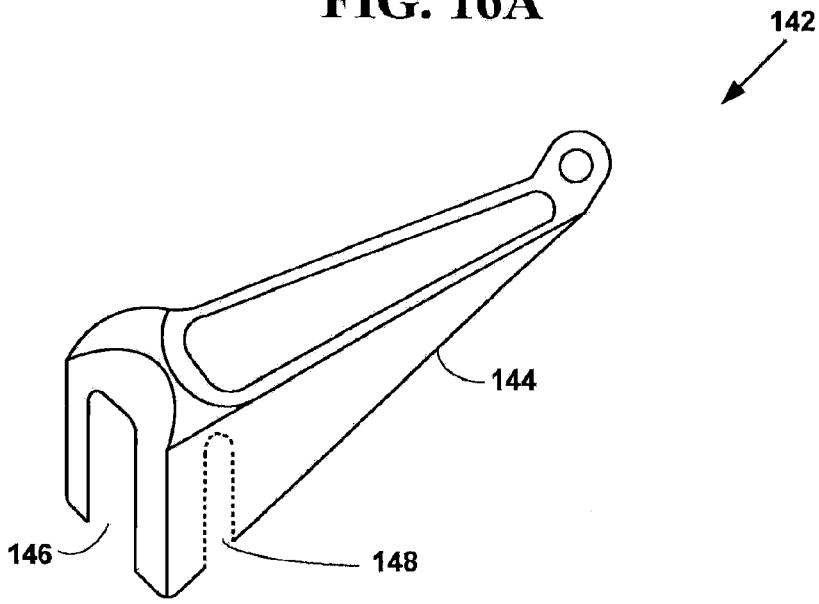
FIG. 16B
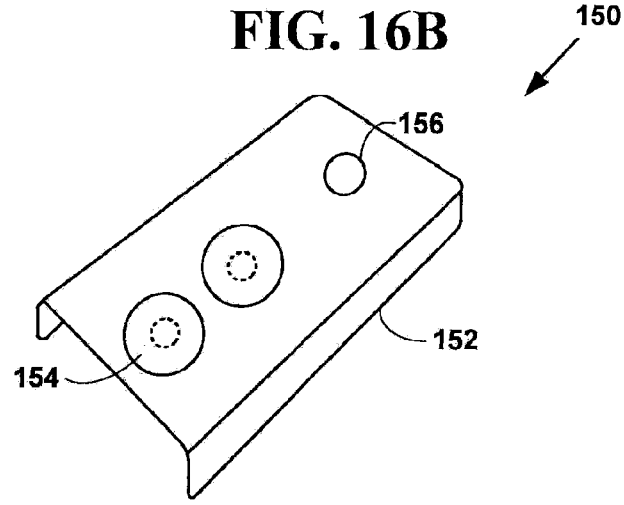
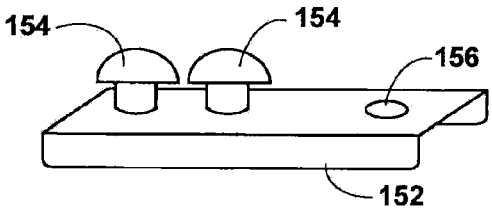
FIG. 16C

PULTRUDED/EXTRUDED UTILITY LIGHTING, MOUNTING AND CLIMBING STRUCTURES

CROSS REFERENCES TO RELATED APPLICATIONS

This utility application is a Continuation-In-Part (CIP) of U.S. application Ser. No. 12/613,879, filed Nov. 9, 2009, which is a CIP of U.S. application Ser. No. 11/803,977, filed May 16, 2007, that claims priority to U.S. Provisional application 60/801,856 filed May 18, 2006. This CIP application also claims priority to U.S. Provisional application Nos. 61/250,647 and 61/250,658 filed Oct. 12, 2009, 61/251,854, filed Oct. 15, 2009 and 61/305,598, filed Feb. 10, 2010. The contents of all listed applications are incorporated herein by reference.

FIELD OF INVENTION

This application relates to pultruded and extruded structures. More specifically, it relates to pultruded/extruded utility lighting, mounting and climbing structures.

BACKGROUND OF THE INVENTION

Most utility poles used today made of wood. Utility poles are divided into ten classes, from 1 to 10. The classes' definition specifies a minimum circumference that depends on the species of tree and the length of the pole. This circumference is measured 6 feet from the butt of the pole. There is also a minimum top circumference that is the same for all species and lengths.

For example, a class 1 pole has a minimum top circumference of 27 inches. If it is 25 feet long and cedar (most utility poles are cedar), the circumference measured 6 feet from the bottom must be at least 43.5 inches.

The higher the class number, the skinnier the pole. Pole lengths start at 16 feet and increase by 2-foot steps to 22 feet, then by fives from 25 feet to 90 feet. A 90-foot class 1 western red cedar pole weighs about 6,600 pounds. A 16-foot pole weighs only about 700.

All utility poles used are pressure treated to preserve the wooden utility poles from the weather, insects and other types of attacks and decay. Utility poles are treated with a number of toxic chemicals including pentachlorphenol, chromated copper arsenate, creosote, copper azole and others.

Pentachlorophenol (Penta) is widely-used wood preservative that is normally dissolved in a petroleum carrier. It is the most commonly used preservative system utilized by North American utilities.

Chromated Copper Arsenate (CCA) is water-borne treatment that offers a wide range of advantages for treated lumber, timber and poles; clean; odorless; paintable. For poles, its use is limited to southern yellow pine, pinus sylvestris, and western red cedar.

Creosote is an oil-based wood preservative blended from the distillation of coal tar and comprised of more than 200 major constituents. Used in industrial applications, such as railroad ties, piling (both salt water and fresh water), and for utility poles.

Copper Azole (CA-B) is a water-borne copper based wood preservative with an organic co-biocide (Tebuconazol). Similar in color, to CCA-C, odorless, clean, paintable or stainable. Copper Azole is approved by the American Wood Preservers Association for use on Western Red Cedar and Southern Yellow Pine utility poles.

There are several problems associated with wooden utility poles. One problem is that utility poles are heavy and bulky and hard to move and install. Another problem is that wooden utility poles are treated with chemicals that are harmful to the environment, and poisonous (e.g. arsenic, etc.) to humans and animals and have been shown in some instance to cause cancers. Another problem is that even with pressure treating the wood, wooden utility poles have to be replaced about every ten years. Another problem is that wooden utility poles are not aesthetically pleasing to look and are typically all a brown or black color.

There are also problems associated with transmission towers to which high voltage electrical lines a are attached. An electricity pylon or transmission tower is a tall, usually steel lattice structure used to support overhead electricity conductors for electric power transmission. The structure is usually made from lynx triangles because if another shape is used it would slowly bend out of shape without bending the joints. The result would be a bent or broken pylon. For example if a rectangle is used it would bend into the shape of a parallelogram due to the associated forces.

One problem is that transmission towers are hard to design, expensive to build and hard to maintain. The transmissions towers are subject to large forces including those related to the transmission components such as wires and cable and environmental forces such as wind, rain, snow, ice, etc.

Another problem is that transmission towers often require additional support. Yet another problem is that transmission towers are difficult for maintenance workers and technicians to climb.

Another problem is that it is difficult to handle and install pultruded and extruded utility structures.

Another problem is that pultruded and extruded utility structures are not used for light poles.

There have been attempts to solve some of these problems. For example, U.S. Pat. No. 7,159,370 that issued to Oliphant, et al. entitled "Modular fiberglass reinforced polymer structural pole system" teaches "This invention is a modular pole assembly comprised of corner pieces and panel members. Panel members are slidably engaged to the corner pieces and are retained in a direction normal to the engagement direction by a track in each slot that nests within a groove in each panel member. Comer pieces may include multiple slots along each side, allowing for multiple layers of panel members along each side, thereby increasing strength and allowing an insulative and structural fill material to be added between panel member layers. The height of the modular pole may be increased by inserting splicing posts between consecutive, adjacent corner members and inserting splicing pieces between co-planar adjacent panel members. The modular nature of the pole assembly provides for simple packaging and shipment of the various components and easy assembly at or near the installation location."

U.S. Pat. No. 6,453,635 that issued to Turner entitled "Composite utility poles and methods of manufacture" teaches "Composite utility pole structures and methods of manufacture using a pultrusion process. The poles may be N sided, with longitudinal pre-stressed rovings in each corner. The inner periphery of the poles may have flat regions centered between the outside corners, with the flat regions joined by circular arcs in the corner regions. Various pole structures and methods of manufacture are described, including curved poles and poles having walls that are tapered in thickness and structure."

U.S. Pat. No. 6,357,196 that issued to McCombs entitled "Pultruded utility pole" teaches "A hollow fiberglass utility pole includes a pair of segments that are a fiberglass sheet that has a semicircular cross-section. The segments have first and second longitudinal edges with male and female couplers respective shapes that have a complimentary relationship to each other for mechanical engagement thereof The fiberglass pole is assembled by engaging the first longitudinal edge of one segment with the second longitudinal edge of the other segment at an installation site. The fiberglass pole may be used as a sheath to encase an existing wooden pole."

U.S. Pat. No. 5,311,713 that issued to Goodrich entitled Electric and telephone pole ground protector teaches "A device and method for protecting the end of a wooden utility pole set in the ground. A split cylindrical casing is provided which can be placed around the lower end of a wooden utility pole just before it is installed in the ground. The casing comprises an elongate, relatively thin cylindrical member having one closed end and being split into two sections connected together along the side thereof The connection acts as a hinge. The edges of the casing where it is split are provided with a fastener, one part of the fastener being disposed along the edge of one part of the casing and another part of the fastener being disposed along the edge of the other part of the casing. When the cylindrical casing is closed, the edge of one part overlaps the edge of the other part so that the respective parts of the fasteners fit matingly together. Preferably, the fastener extends the entire length of the casing and entirely across the bottom end thereof. Preferably, the casing is made of high grade plastic."

U.S. Pat. No. 5,175,971 that issued to Maccomb entitled 'Utility power pole system" teaches "A utility power pole system comprises a pultruded hollow primary pole having an external hexogonal cross section and a number of longitudinal exterior grooves along its length. The hollow primary pole also has an internal hexogonal cross section rotated 30.degree. relative to the external hexagonal cross section. One or more pultruded hollow liners are provided which are also hexagonal in cross section and which may be internally or externally concentric with the primary pole. These liners vary in length to achieve an effective structural taper to the power pole system. The insertion of a tapered liner in the lower portion of the utility pole results in a utility pole having the effective load bearing capability of a tapered utility pole. By using a plurality of overlapping liners of varying lengths, an effective taper can be provided to the utility pole. The longitudinal grooves in the outer surface of the primary pole provide a means for climbing for a utility lineman and a means for attaching accessory attachment devices such as cross arms, stiffening members, conductor supports and for interconnection with other structural elements in a more extensive system. The rounded edges of each longitudinal groove are directed inwardly so as to retain devices in the groove which conform to the cross section of the groove. Cross arms attached to the utility pole may also employ similar longitudinal grooves to facilitate interconnection with existing utility hardware or other components."

U.S. Pat. No. 4,803,819 that issued to Kelsey entitled "Utility pole and attachments formed by pultrusion of dielectric insulating plastic, such as glass fiber reinforced resin" teaches "a utility pole and attachments formed by pultrusion of dielectric insulating plastic, such as glass fiber reinforced resin."

However, none of these solutions overcome all of the problems with utility poles and utility structures. Thus, it would be desirable to solve some of the problems associated with utility poles and utility structures.

SUMMARY OF THE INVENTION

In accordance with preferred embodiments of the invention, some of the problems associated with utility poles and utility structures are overcome. Pultruded and/or extruded lighting structures, mounting and climbing structures are presented.

The lighting structures comprise plural pullwound pultruded cylindrical structures and a mounting structure. The lighting structures also include plural types of climbing components.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein:

FIGS. 12A & B are block diagrams illustrating an attachable/detachable climbing component used on the exemplary utility line support structure;

FIGS. 16A, B, & C are block diagrams illustrating pultruded/extruded climbing components;

DETAILED DESCRIPTION OF THE INVENTION

Exturded Utility Structures

"Extrusion" is a manufacturing process where a material is pushed and/or drawn through a die to create long objects of a fixed cross-section. Hollow sections are usually extruded by placing a pin or mandrel in the die. Extrusion may be continuous (e.g., producing indefinitely long material) or semi-continuous (e.g., repeatedly producing many shorter pieces). Some extruded materials are hot drawn and others may be cold drawn.

The feedstock may be forced through the die by various methods: by an auger, which can be single or twin screw, powered by an electric motor; by a ram, driven by hydraulic pressure, oil pressure or in other specialized processes such as rollers inside a perforated drum for the production of many simultaneous streams of material.

Plastic extrusion commonly uses plastic chips, which are heated and extruded in the liquid state, then cooled and solidified as it passes through the die. In some cases (such as fiber reinforced tubes) the extrudate is pulled through a very long die, in a process called "pultrusion."

Figure 1:
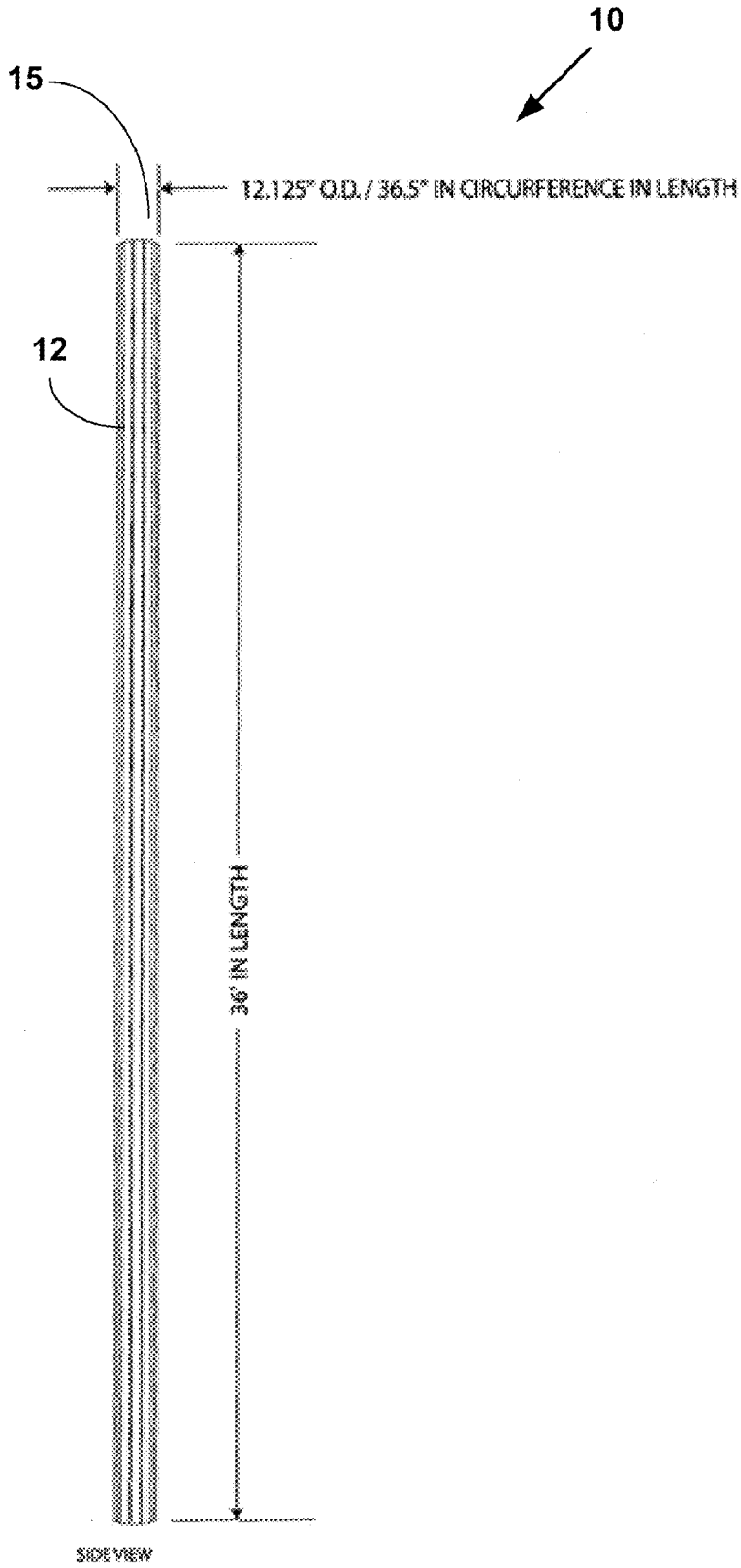
FIG. 1 is a block diagram illustrating a side view of an exemplary extruded hollow structure.

FIG. 1 is a block diagram illustrating a side view 10 of an exemplary extruded hollow structure 12.

In one embodiment, the extruded structure 12 comprises extruded plastic materials including, but not limited to, Polyvinyl Chloride (PVC), Acrylonitrile Butadiene Styrene (ABS), High Impact Polypropylene (HIP), Polypropylene, High-Density Polyethylene (HDPE), Polycarbonate, Polyethylene Terephthalate Glycol (PETG), Nylon, Fiber reinforced Polypropylene, Fiber Reinforced Plystyrene and other types of plastics. In another embodiment, the extruded structure 12 comprises composite materials. In another embodiment, the extruded structure l2 comprises recycled plastic materials.

The extruded structure 12 is extruded in plural different colors (e.g., red, green, yellow, blue, brown, etc.) and is aesthetically pleasing. The plural different colors may blend in with a natural environmental setting or a pre-determined design scheme. For example, a new subdivision may include only blue extruded utility poles.

In one exemplary embodiment, the extruded structure 12 is an extruded plastic utility pole 12 of extruded to a length of at least 36' in length. The exemplary extruded structure 12 has an outside at least 12.125" and a 36.5" circumference. However, the present invention is not limited to the dimensions described and other extruded utility poles 12 of other lengths and dimensions can also be used to practice the invention.

In one embodiment, the extruded structure 12 includes a pre-determined length (e.g., 8 feet, 16 feet, 24 feet, 36 feet, 40 feet, 65 feet etc.). However, the present invention is not limited to these lengths and other lengths can be used to practice the invention.

In one embodiment, a 36' length of the extruded structure 12 weighs about 100 pounds. It is estimated that a 36' length of the extruded structure 12 has a tensile strength of about 8,500 pounds per square inch (PSI). As is known in the art, the "tensile strength" is a maximum stress that a material can withstand before necking As is known in the art "necking" is a mode of deformation where relatively large amounts of strain localize disproportionately in a small region of an object. As is known in the art, "hoop strength" includes strength against a circumferential stress in a cylindrically shaped part as a result of an internal or external pressure.

It is estimated that an extruded structure 12 would have a lifetime of over 100 years and be safe to the environment, humans and animals. The extruded structure 12 is resistance to damage from the weather, animals, insects and is corrosion resistant.

Figure 2:
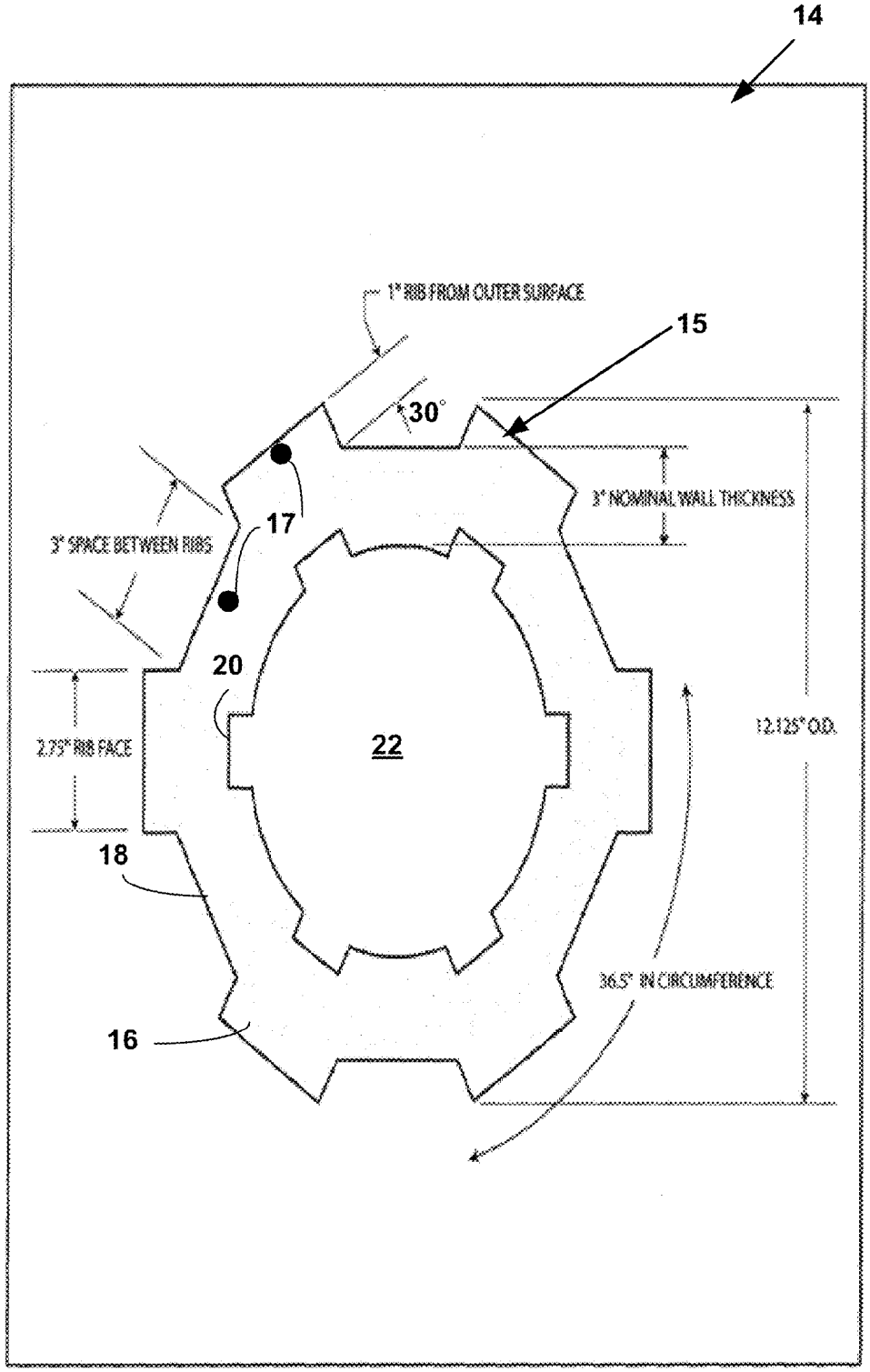
FIG. 2 is a block diagram illustrating a top view of an exemplary extruded hollow structure.

FIG. 2 is a block diagram illustrating a top view 14 of an exemplary extruded structure 15. In one exemplary embodiment, the exemplary extruded structure 12 includes plural ribbed faces. The plural rib faces 16 are connected with plural angular faces 18. An inner surface of the plural rib faces 16 includes plural intrusions 20. The plural intrusions 20 are in alignment with the plural ribbed faces 16.

In one embodiment the plural intrusions 20 are used a channel to hold plural different sets of wires such as communications wires or antenna wires.

FIG. 2 is illustrated with an exemplary embodiment. However, the present invention is not limited to such an embodiment and other embodiments can also embodiments can also be used to practice the invention.

In such an embodiment, exemplary extruded structure 12 includes plural flat rib faces 16. In one embodiment, the plural flat rib faces include a width of about 2.75". The plural flat rib faces 16 comprise a rib of about 1" from the outer surface of the extruded structure 12. The plural flat rib faces 16 are connected with plural angular faces 18. In one embodiment, the plural angular faces 18 include an angle of about 30 degrees and a flat surface of about 3" in width. The extruded utility pole includes a circumference of about 36.5" and an outside diameter of about 12.125". An inner surface of the plural flat rib faces 16 includes plural flat intrusions 20. The plural flat intrusions 20 can be used a channel to hold plural different sets of wires such as communications wires or antenna wires.

However, the present invention is not limited to the shapes and dimensions described and other extruded structures 12 of other shapes and dimensions can also be used to practice the invention.

In one embodiment, the extruded structure 12 includes one or more receptacles are pre-determined heights in the plural flat rib faces 16. In such an embodiment, the one or more receptacles are used for adding utility components such utility boxes, etc. The one or more receptacles may include pre-determined features such as a screw pattern or other pattern for inserted a screw or other attachment means.

In another embodiment, the plural flat rib faces 16 include plastic, nylon, composite materials or other types of filaments to add additional strength to the extruded structure 12.

In another embodiment, the plural flat rib faces 16 include integral copper wires 17 that allow the extruded structure 12 to be used an antenna for wireless or other types of communications. In another embodiment, the integral copper wires are embedded into other surfaces of extruded structure 12.

FIG. 2 illustrates an extruded structure 12 with a hollow core 22. In such an embodiment, communications wires (e.g., fiber optic, copper, coaxial cable, etc.) or antenna wires can be run through the hollow core (as well as the plural flat intrusions 20) to connect to other communications wires buried underground in dirt or sub-terrain pipes or tunnels. This avoids connecting unsightly communications wires between two or more extruded structure 12 and protects the communications wires or antenna wires from damage by the weather and animals.

FIG. 2 illustrates an extruded structure 12 with a hollow core. However, the present invention is not limited to this embodiment and the extruded structure 12 can be extruded as solid piece of material. In such an embodiment, the weight of the extruded structure 12 would be more than 100 pounds and have a different tensile strength.

In one embodiment, the extruded structure 12 includes a fiber or webbing re-enforced cylindrical structure comprising a utility pole, a lighting pole, a structural support, an architectural design element (interior or exterior), a marine dock element or a fencing element.

In one embodiment, the extruded structure 12 includes additional fiberglass, plastic, ester, polyester, nylon, composite materials or other types of filaments or webbing to add additional strength to the extruded structure 12. The filaments or webbing are applied internally or externally to the extruded structure 12.

The structure of the external and internal surfaces in an alternating and repeating pattern of the extruded structure 12 provides additional tensile strength to the structure. In addition, the angular lines of the structure are aesthetically pleasing.

In addition, the shape of the extruded structure 12 provides an optimal resistance, or near optimal resistance to wind shear forces.

Pultruded Utility Structures

As is known in the art, "pultrusion" is a manufacturing process for producing continuous lengths of materials. Pultrusion raw materials include a liquid resin mixture (e.g., containing resin, fillers and specialized additives) and reinforcing fibers (e.g., fiberglass, composite materials, etc.). The process involves pulling these raw materials (rather than pushing as is the case in extrusion) through a heated steel forming die using a continuous pulling device. The reinforcement materials are in continuous forms such as rolls of fiberglass mat or doffs of fiberglass roving. As the reinforcements are saturated with the resin mixture in the resin impregnator and pulled through the die, the gelatin (or hardening) of the resin is initiated by the heat from the die and a rigid, cured profile is formed that corresponds to the shape of the die.

There are also protruded laminates. Most pultruded laminates are formed using rovings aligned down the major axis of the part. Various continuous strand mats, fabrics (e.g., braided, woven and knitted), and texturized or bulked rovings are used to obtain strength in the cross axis or transverse direction.

The pultrusion process is normally continuous and highly automated. Reinforcement materials, such as roving, mat or fabrics, are positioned in a specific location using preforming shapers or guides to form a pultrusion. The reinforcements are drawn through a resin bath where the material is thoroughly coated or impregnated with a liquid thermosetting resin. The resin-saturated reinforcements enter a heated metal pultrusion die. The dimensions and shape of the die define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

In one embodiment the pultrusion resins include bisphenol-a epichlorohydrin-based vinyl esters. In another embodiment, the resins include polyesters including isophthalic, orthophthalic, propylene-maleate, fire resistant, and high cross-link density. However, the present invention is not limited to these resins and other resins can be used to practice the invention.

In one embodiment, the pultrusions include re-enforcing fibers comprising, fiberglass fibers, composite fibers, etc. However, the present invention is not limited to these resins and other resins can be used to practice the invention.

One resin used in fiberglass pultrusions is a thermoset resin. The resin used in Polyvinyl Chloride (PVC) pultrusions are typical thermoplastic resins. In the pultrusion process, under heat and pressure, the thermoset resins and re-enforcing fibers form a new inert material that is impervious to temperature. Pultruded fiberglass physical properties do not change through the full temperature cycle up to temperatures of about 200 degrees Fahrenheit (° F.). In direct contrast, PVC resins typically become unstable at temperatures greater than 155° F.

Pultrusions, include but are not limited to, structures comprising: (1) HIGH STRENGTH—typically stronger than structural steel on a pound-for-pound basis; (2) LIGHTWEIGHT—Pultrusions are 20-25% the weight of steel and 70% the weight of aluminum. Pultruded products are easily transported, handled and lifted into place; (3) CORROSION/ROT RESISTANT—Pultruded products will not rot and are impervious to a broad range of corrosive elements; (4) NON-CONDUCTIVE—fiberglass reinforced pultrusions have low thermal conductivity and are electrically non-conductive; (5) ELECTRO-MAGNETIC TRANSPARENT—Pultruded products are transparent to radio waves, microwaves and other electromagnetic frequencies; (6) DIMENSIONAL STABILE—The coefficient of thermal expansion of pultruded products is slightly less than steel and significantly less than aluminum; (7) LOW TEMPERATURE CAPABLE—FiberGlass fiber reinforced pultrusions exhibit excellent mechanical properties at very low temperatures, even −70° F. Tensile strength and impact strengths are greater at −70° F. than at +80° F.; (8) AESTHETICLY PLEASING—Pultruded profiles are pigmented throughout the thickness of the part and can be made to virtually any desired custom color. Special surfacing veils are also available to create special surface appearances such as wood grain, marble, granite, etc.; and (9) COST EFFICTIVE—pultruded products are cheaper than those made of metals, wood, etc. and other materials.

In another embodiment the extruded utility structures described above and illustrated in FIGS. 1 and 2 are pultruded. In such embodiments a pultrusion die is created based on the desired design shape illustrated FIG. 2.

Figure 3:
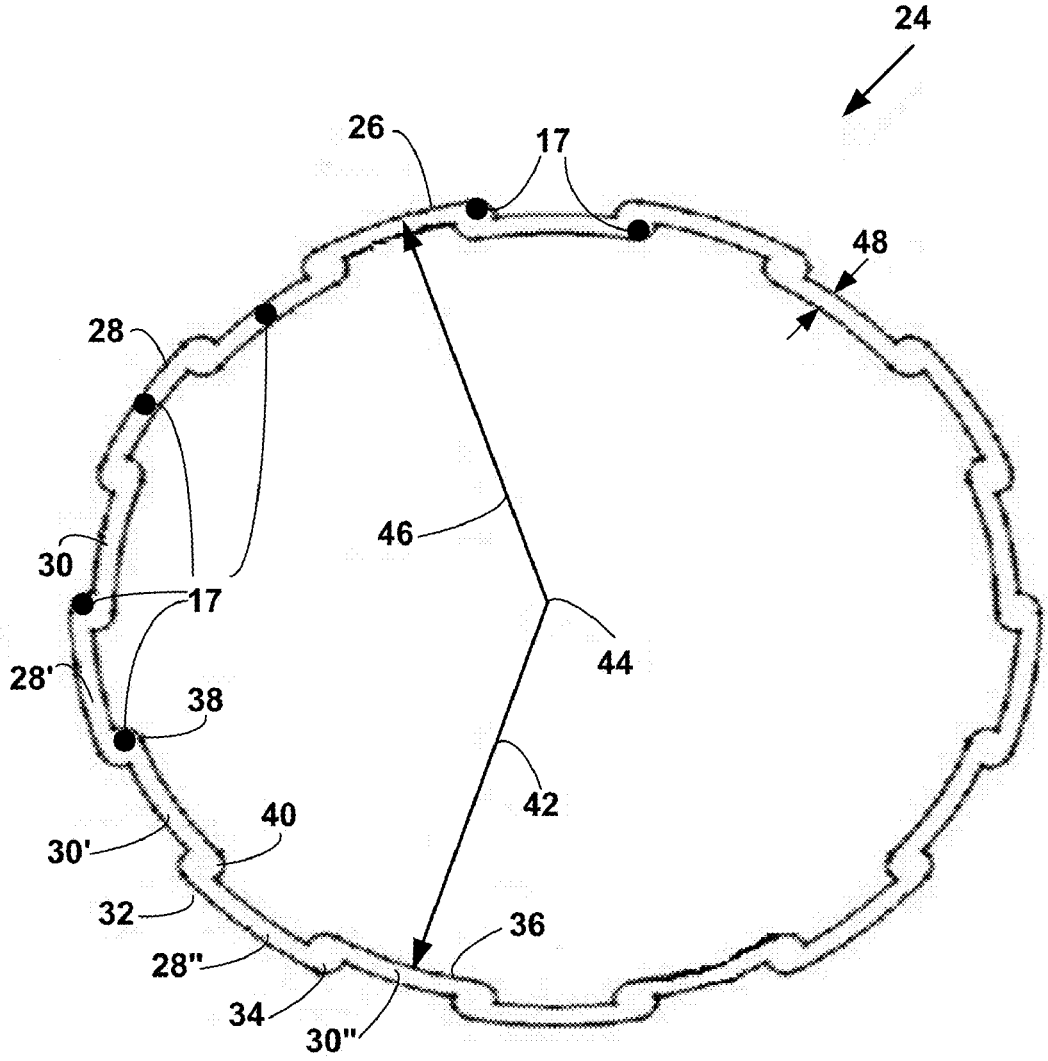
FIG. 3 illustrates a cross-section of a pultruded hollow structure.

FIG. 3 illustrates a cross-section of a pultruded hollow cylindrical structure 24. In one embodiment the pultruded hollow cylindrical structure includes an external surface 26 including plural protruding components 28 connected to plural intruding components 30. A protruding component 28' includes two curved components 32, 34 for connecting the protruding component 28' to two other intruding components 30' and 30".

The pultruded hollow cylindrical structure 24 further includes an internal surface 36 including plural intruding components 30 connected to the plural protruding components 28. An intruding component 30' includes two curved components 38, 40, to connect the intruding component 30' to two other protruding components 28' and 28"

The curved components 32, 34, 38, 40 include a pre-determined radius with two outer radius portions on an protruding component 28' and two inner radius portions on an intruding component 30'.

The pultruded hollow cylindrical structure includes a pre-determined inner radius 42 from a center point 44 to an inner portion of the internal surface 36 and includes a pre-determined outer radius 46 from the center point 44 to an outer portion of the external surface 26. The difference between the pre-determined inner radius and pre-determined outer radius determines a thickness 48 of the pultruded hollow cylindrical structure 24. The thickness 48 was determined experimentally to provide maximum tensil strength, torsional strength and hoop strength.

The pultruded hollow cylindrical structure 24 includes a pre-determined length and a pre-determined color.

In one embodiment, a pultrusion die is created with the design shape and dimensions illustrated in FIG. 3. However, the present invention is not limited to such an embodiment and other embodiments with other dimensions can be used to practice the invention.

The structure of the external and internal surfaces in an alternating and repeating pattern of the pultruded hollow cylindrical structure 14, 24. It has been determined experimentally that the repeating pattern of alternating curved inner and outer surfaces push against in each in a manner to distribute forces (e.g., wind, etc.) downward (instead of sideways or twisting) along a length of the pultruded hollow cylindrical structure 14, 24. This provides provide maximum tensil strength, torsional strength and hoop stength to the structure.

In addition, the curved lines of the repeating pattern of the pultruded hollow cylindrical structure 14, 24 are aesthetically pleasing. In addition, the curved shape of the pultruded hollow cynlindrical structure 14, 24 provide an optimal resistance, or near optimal resistance to wind shear forces by providing plural channels to distribute the wind forces.

FIG. 3 illustrates a pultruded hollow cylindrical structure 24 with a hollow core. However, the present invention is not limited to this embodiment and the pultruded structure 24 can be pultruded as solid piece of material by changing the plutrusion die.

Figure 4:
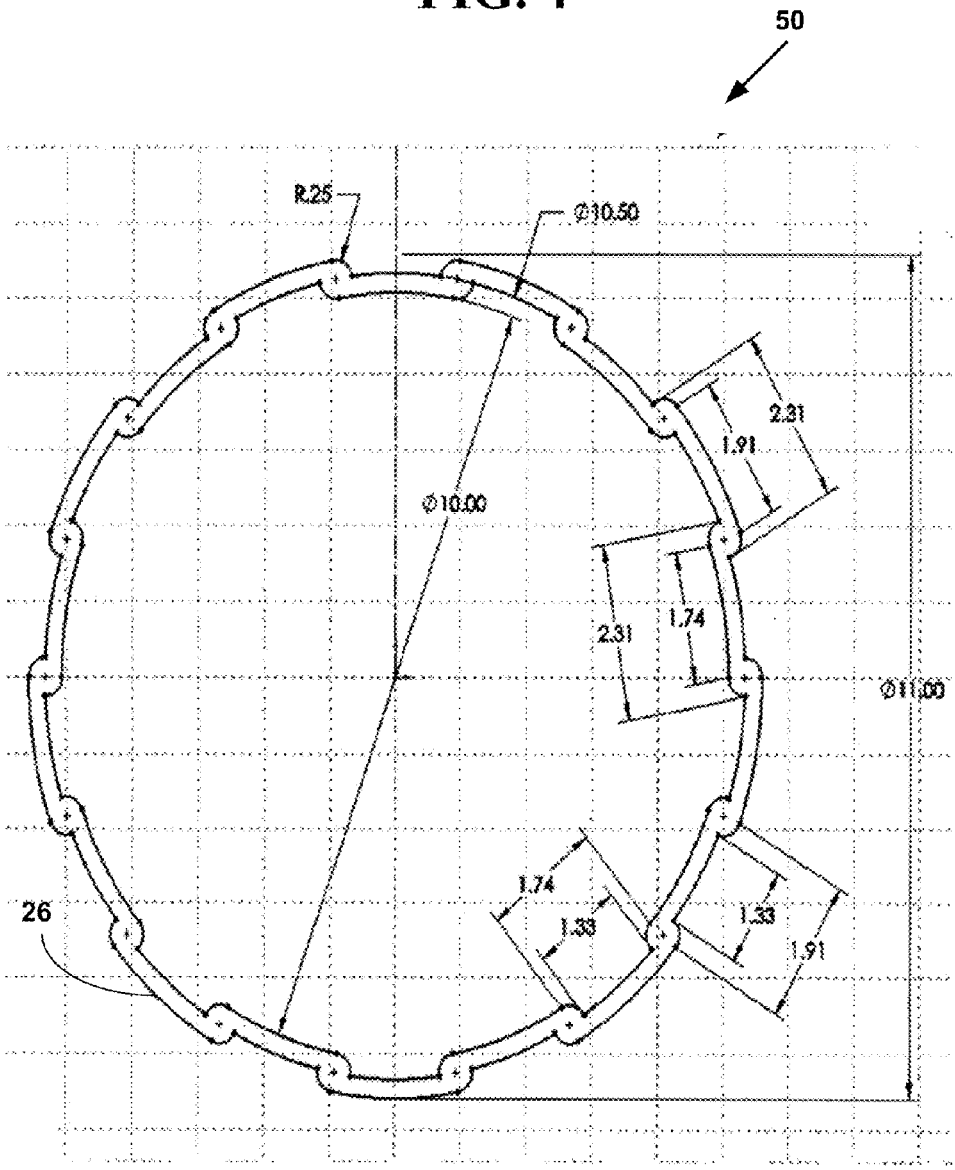
FIG. 4 illustrates a cross-section of an exemplary pultruded hollow structure.

FIG. 4 illustrates a cross-section of an exemplary pultruded hollow structure 50. In this cross section, the pultruded hollow structure 50 includes an inner radius of 5.0 inches an inner diameter of 10.0 and an outer radius of 5.5 inches and an outer diameter of 11.00 inches and a radius of the curved surfaces of 0.25 inches. The thickness of the structure 50 can be increased by increasing the radius of the curved surfaces and/or decreasing the inner radius of the structure 50. However, the present invention is not limited to these exemplary measurements or this exemplary embodiment and other measurement and embodiments can also be used to practice the invention.

Figure 5:
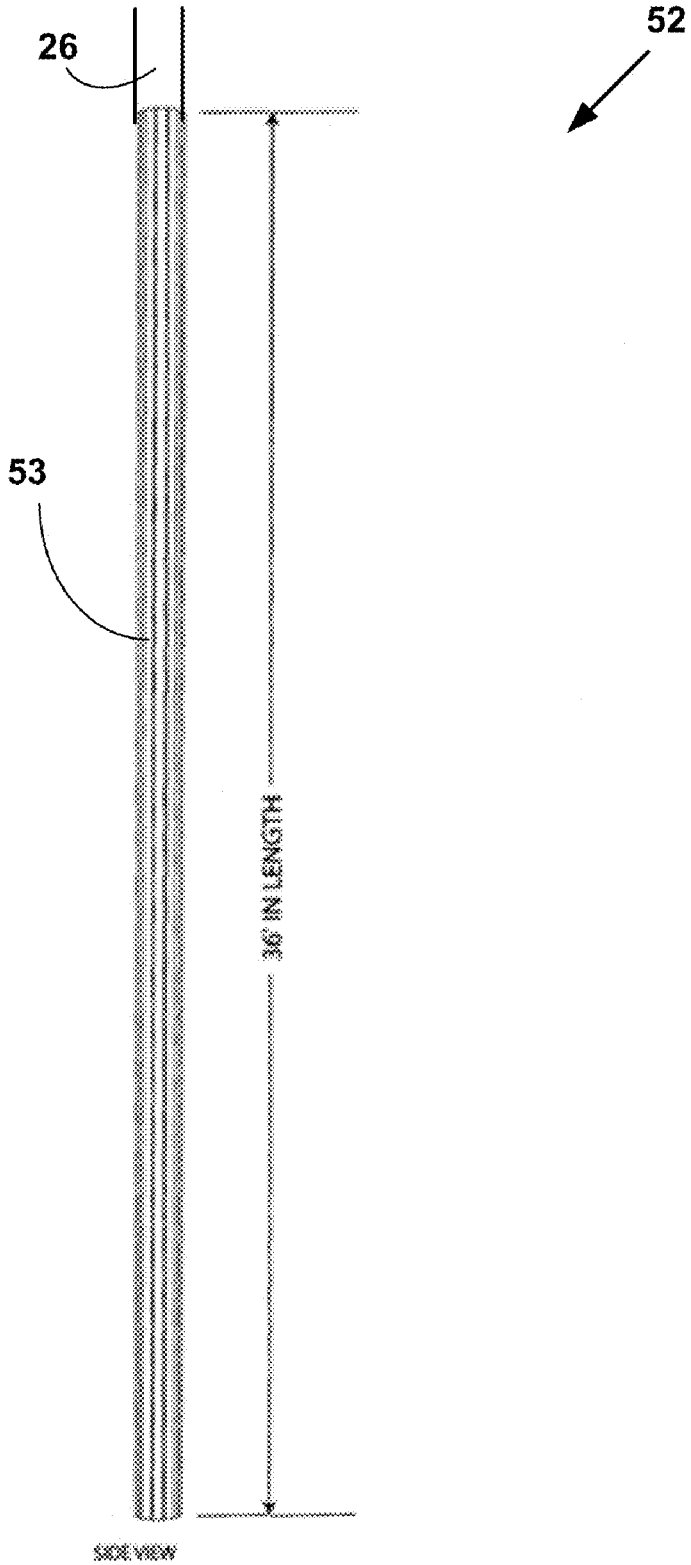
FIG. 5 illustrates a block diagram of a side view of an exemplary pultruded hollow structure.

FIG. 5 illustrates a block diagram 52 of a side view of an exemplary pultruded hollow structure 53. In this figure the pultruded hollow cylindrical structure 53 includes the pultruded hollow cylindrical structure 24 with a hollow core 26 as is illustrated in FIG. 3.

The pultruded hollow cylindrical structure 53 is illustrated with an exemplary embodiment as is illustrated in FIG. 4. However, the present invention is not limited to this embodiment and other embodiments can also be used to practice the invention.

In one embodiment, the pultruded hollow cylindrical structure 53 includes a cylindrical structure comprising a utility pole, a lighting pole, a structural support, an architectural design element (interior or exterior), a marine dock element or a fencing element, etc.

The pultruded hollow cylindrical structures 14, 24 include a pre-determined length (e.g., 8 feet, 16 feet, 24 feet, 36 feet, 40 feet, 65 feet etc.). However, the present invention is not limited to these lengths and other lengths can be used to practice the invention.

The pultruded hollow cylindrical structures 14, 24 includes plural different colors (e.g., red, green, yellow, blue, brown, etc.) and is aesthetically pleasing. The plural different colors may blend in with a natural environmental setting or a pre-determined design scheme. For example, a new subdivision may include only blue utility poles, while a boat dock may include only high visibility orange decking comprising the pultruded hollow cylindrical structures 14, 24. However, the present invention is not limited to these colors and other colors can be used to practice the invention.

The pultruded hollow cylindrical structure 24 includes a repeating pattern of alternating protruding and intruding components.

In one embodiment, the pultruded hollow cylindrical structure 24 includes one or more receptacles at pre-determined heights. In such an embodiment, the one or more receptacles are used for adding utility components such utility boxes, etc. The one or more receptacles may include pre-determined features such as a screw pattern or other pattern for inserted a screw or other attachment means.

In one embodiment, the plural protruding components and plural intruding components include additional fiberglass, plastic, ester, polyester, nylon, composite materials or other types of filaments or webbing to add additional strength to the pultruded hollow cylindrical structure 24. The filaments or webbing are applied internally or externally to the pultruded hollow cylindrical structure 24.

In another embodiment, the pultruded hollow cylindrical structure 24 includes integral copper wires 17 in or more surfaces that allow the structure to be used an antenna for wireless or other types of communications.

Various exemplary and specific measurements are described herein. However, the present invention is not limited to these exemplary and specific measurements. In addition, the extruded and pultruded structures described herein can be made with specific measurements for actual products such as 2×4's, structural beams, fencing, wooden telephone poles, etc. In such embodiments, the extruded or pultruded structures may be thicker then necessary and may include the shapes of the actual products instead of the shapes describe herein.

Utility Line Support Structures

In another embodiment, the extruded or pultruded structures include a utility line support structure.

Figure 6:
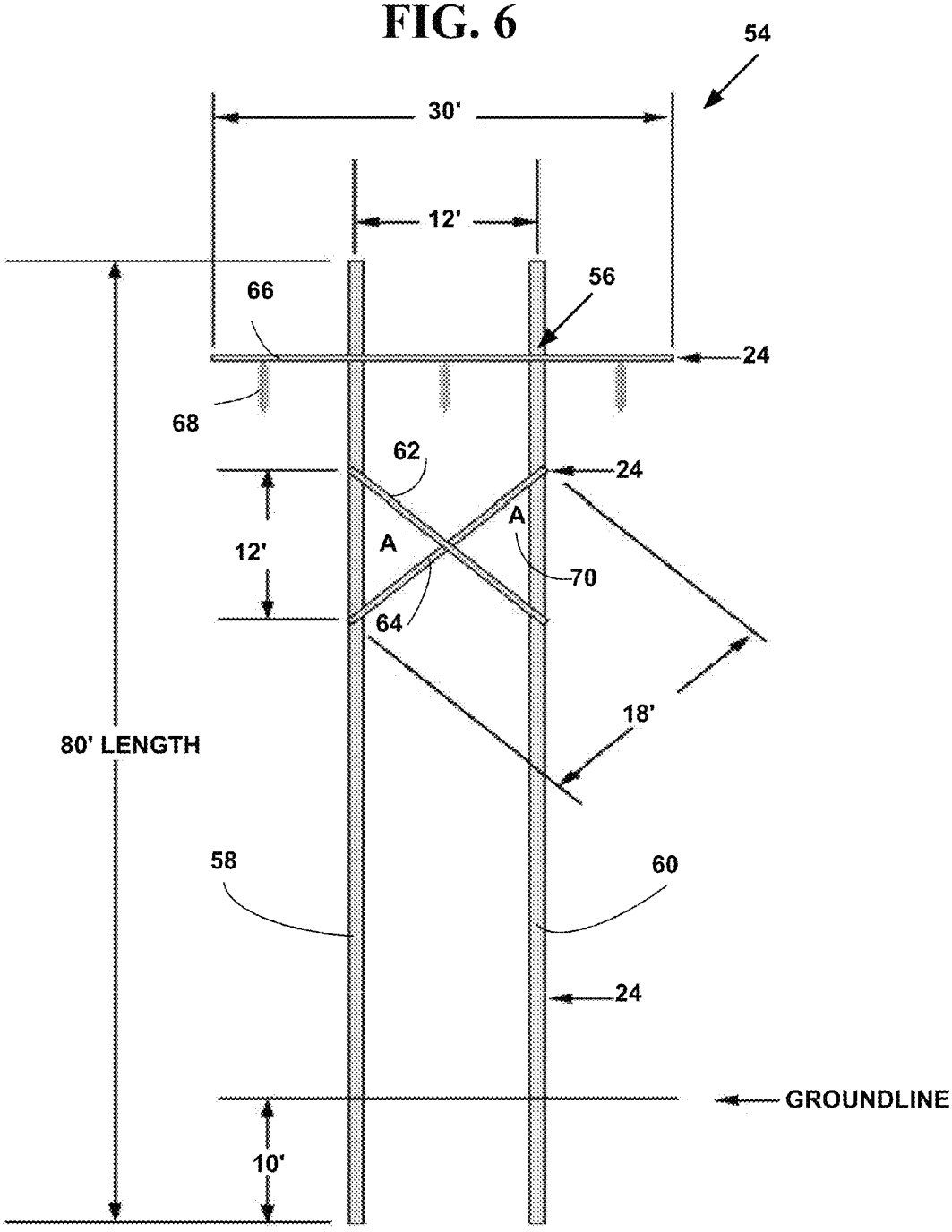
FIG. 6 is a block diagram illustrating an exemplary transmission support structure.

FIG. 6 is a block diagram 54 illustrating an exemplary utility line support structure 56. The utility line support structure is easier to design, install and maintain than transmission towers designed and built from steel, wood and other materials. No special triangular or trapezoidal design is necessary with structure 56.

The exemplary utility line support structure 56 is composed of a first and a second hollow cylindrical structures comprising two leg components 58, 60 having two legs extending upward in an H-frame shape. In one embodiment, the first leg component 58 and the second leg component 60 include either extruded structures (FIGS. 1-2) and/or pultruded structures (FIGS. 3-5) or any combination thereof.

However, the present invention is not limited to these structures and other structures can also be used to practice the invention The utility line support structure 56 includes a pair of composite cross braces 62, 64 that extend between and are connected at their ends between two leg sections 58, 60 and include a support structure in the shape of the letter "X". However, the present invention is not limited to this attachment shape and other attachment shapes can also be used to practice the invention.

In one embodiment, a first end and a second end of the first cross-brace 62 and the second cross-brace 64 are connected at a pre-determined angle-A 70 between the first leg 58 and the second leg 60. In one embodiment, a length between attaching the cross braces 62, 64 to the two leg sections 58, 60 at the pre-determined angle-A 70 is at a length of at least 12 feet. However, the present invention is not limited to this attachment length and other lengths can also be used to practice the invention.

In one exemplary embodiment, the first cross-brace 62 and second cross brace 64 include a length of 18 feet. However, the present invention is not limited to these lengths and other lengths can also be used to practice the invention.

In one embodiment, the two cross braces 62, 64 include either extruded structures 10 (FIGS. 1-2) and/or pultruded structures 52 (FIGS. 3-5) or any combination thereof. However, the present invention is not limited to these structures and other structures can also be used to practice the invention.

In another specific exemplary embodiment, the first cross-brace 62 and the second cross-brace 64 include an extruded and/or pultruded hollow cylindrical structure (FIGS. 1-5) with and outer diameter of 4.125", and inner diameter of 2.25", a thickness of 0.25" and a length of 18 feet. However, the present invention is not limited to these sizes and measurements and other sizes and measurements can also be used to practice the invention. For example the structure 56 may include hollow cylindrical structures for all components what are the same size and shape.

In one embodiment, the cross braces 62, 64 attach to the leg sections 58, 60 by a through bolt and washer. A through bolt and washer join the cross braces 62, 64 at their intersection. However, the present invention is not limited to such an attachment mechanisms and other attachment mechanisms can also be used to practice the invention.

In one embodiment, the two leg sections 58, 60, comprise the hollow pultruded structures 52 illustrated in FIGS. 3-5 but with an overall length of 80 feet. In another embodiment, the two leg sections 58, 60 comprise the hollow extruded structures 10 illustrated in FIGS. 1-2 but with an overall length of 80 feet. However, the present invention is not limited to these structures and other structures can also be used to practice the invention.

In one embodiment, the two leg sections 58, 60 are buried below ground level with a depth of at least 10 feet. However, the present is not limited to such a burial depth and other burial depths and lengths can be used to practice the invention.

The structure 56 is directly embedded into the ground with or without the use of a reinforced concrete footing, depending on soil content, environment, and required load for the structure. The different components of the structure 56 can be all a same color, all in varying colors, or various combinations thereof of color for aesthetics or identifying specific needs.

At the top of the leg sections 58, 60 a cross arm component 66 for supporting electric transmission components 68, electrical sub-transmission components, electrical distribution lines and other loads is connected at attachment points to the first and second leg component 58, 60. The cross arm component 66 horizontally extends past the first and second leg components at a pre-determined distance.

In one embodiment, the cross arm component 66 includes either hollow extruded structures 10 (FIGS. 1-2) and/or pultruded structures 52 (FIGS. 3-5) or any combination thereof. However, the present invention is not limited to these structures and other structures can also be used to practice the invention.

In one specific exemplary embodiment, the cross arm component 66 includes an extruded and/or pultruded hollow cylindrical structure 10, 52 (FIGS. 1-5) with and outer diameter of 6", and inner diameter of 4" and a thickness of 0.25" and a length of 30 feet. However, the present invention is not limited to these sizes and measurements and other sizes and measurements can also be used to practice the invention.

Figure 7:
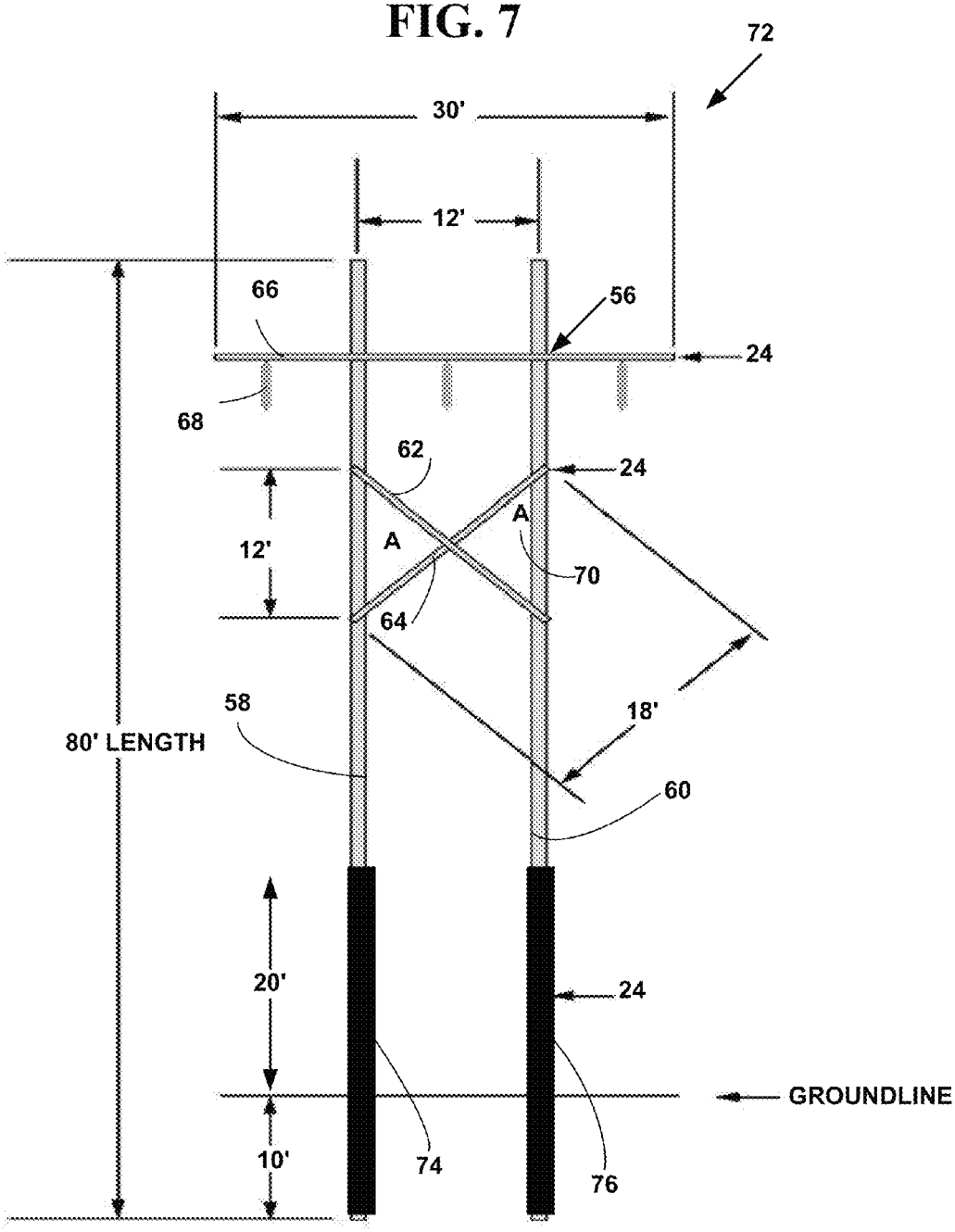
FIG. 7 is a block diagram illustrating another exemplary transmission support structure.

FIG. 7 is a block diagram 72 illustrating another exemplary utility line support structure 56.

A third leg component 74 and a fourth leg component 76 each comprising the hollow cylindrical structure at a fourth pre-determined length are included as components of structure 56. The pre-determined radius with the two outer radius portions on the protruding component and two inner radius portions are larger than the two outer radius portions on the protruding component and two inner radius portions used for the first leg component and the second leg component. A thickness of the hollow cylindrical structure for the third leg component 74 and the fourth leg component 76 is greater than the thickness of the hollow cylindrical component used for the first leg 58 component and the second leg component 60. The third leg component 74 and the fourth leg component 76 are securely embedded into a surface composite utility line support structure. The first leg component 58 since it is smaller in radius is placed within the third leg component 74 and the second leg component 60 since it is smaller in radius is placed in the fourth leg component 75, thereby providing additional strength for the composite utility line support structure 56. The shape of the leg components also provides inter-locking, thereby providing additional structure to the structure that would not have been obtained if the leg components were a smooth circular shape.

In one example, FIG. 2 illustrates an extruded hollow cylindrical structure 16 with an outer diameter of 12.125", and inner diameter of 9.125" and a 3" thickness. In one exemplary embodiment, the third leg component 72 and the fourth leg component 74 include an inner diameter of 10.125" and an outer radius of 13.125" and thickness of 3.5". However, the present invention is not limited to this measurements and other measurements can also be used to practice the invention.

In another example, FIG. 4 illustrates a pultruded hollow cylindrical component 50 with an inner diameter of 10" and an outer diameter of 11" and a thickness of 0.25". In one exemplary embodiment, the third leg component 72 and the fourth leg component 74 include an diameter of 12" and an outer diameter of 13" and thickness of 0.5". However, the present invention is not limited to this measurements and other measurements can also be used to practice the invention.

In one exemplary embodiment, the third leg component 72 and the fourth leg component 74 include a pre-determined length of 40 feet for burial at a 10 foot depth, with 30 feet exposed above a ground line for engaging the first and second leg components 58, 60. In one embodiment, the third leg component 72 and the fourth leg component 74 are equal in length. In another embodiment, the third leg component 72 and the fourth leg component 74 are not-equal in length and are used in areas where the terrain is sloped or un-even or includes natural barriers against insertion such as rock outcrops, rivers, streams, etc. However, the present invention is not limited to these lengths and measurements and other lengths measurements can also be used to practice the invention.

In another embodiment, the first, second, third and fourth leg components 58, 60, 72 and 74 include various combinations of the extruded and pultruded hollow cylindrical components 10, 50, thereby providing different types of interlocking between the hollow cylindrical components with differences in additional strength.

Additional Support Components

Figure 8:
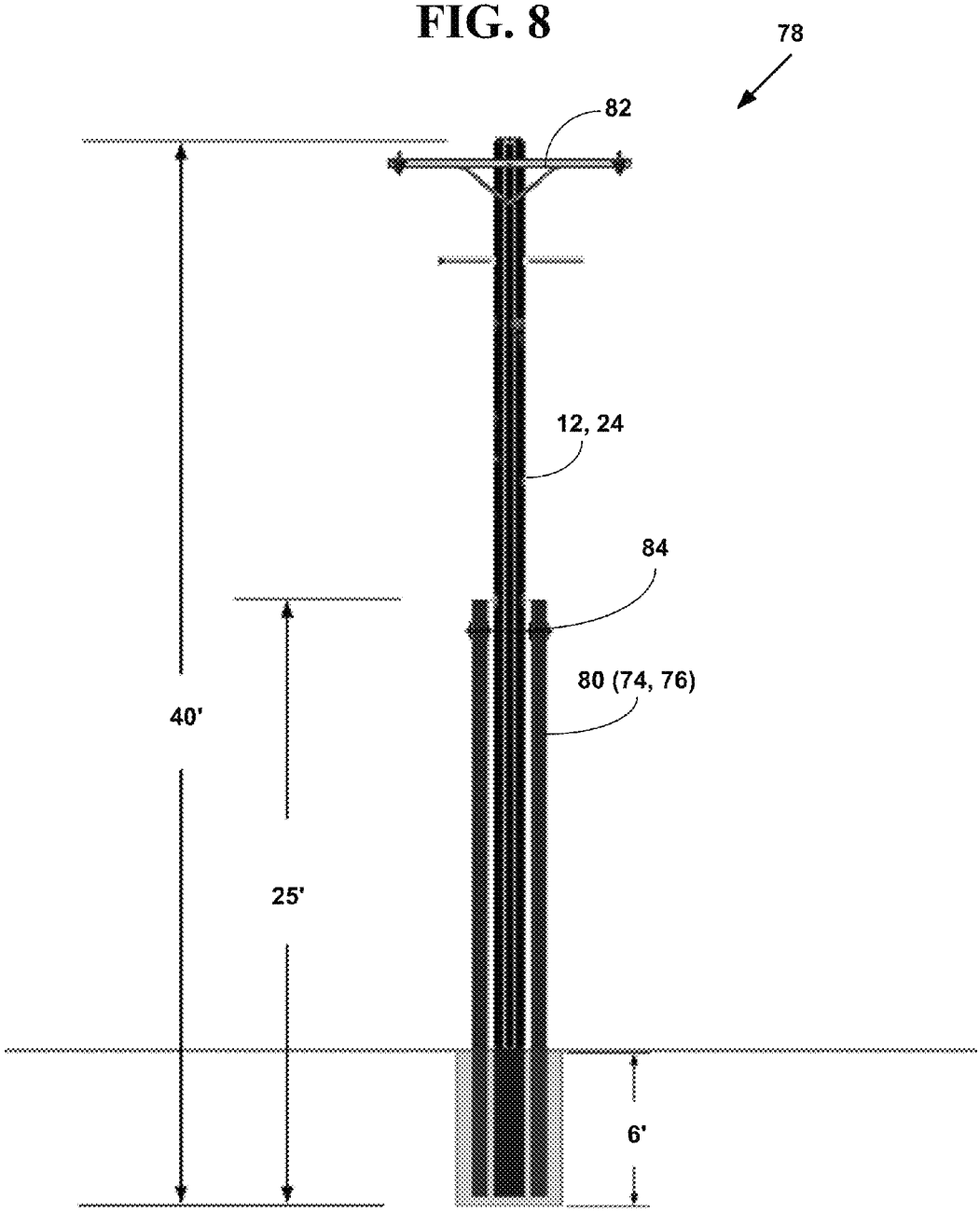
FIG. 8 is a block diagram illustrating a side view of an exemplary transmission structure support component.

FIG. 8 is a block diagram 78 illustrating a side view of an exemplary transmission structure support component 80. The transmission structure support component 80 is illustrated with a single transmission pole 82. The single transmission pole 82 includes extruded and/or pultruded poles 10, 50. FIG. 8 illustrates the transmission structure support component 80 secured in 6 feet concrete and a total length of 25 feet. The exemplary transmission pole 82 is illustrated as 40 feet in length. However, the present invention is not limited to these lengths and measurements and other lengths measurements can also be used to practice the invention.

FIG. 8 illustrates the single transmission pole 82 through bolted 84 into the exemplary transmission structure support component 80. However, the present invention is not limited to such an attachment method and other attachment methods can also be used to practice the invention.

In one embodiment, the transmission structure support component 80 is used as the third leg component 72 and the fourth leg component 74 in the structure 56. However, the present invention is not limited to this embodiment and other embodiments may also be used to practice the invention.

Figure 9:
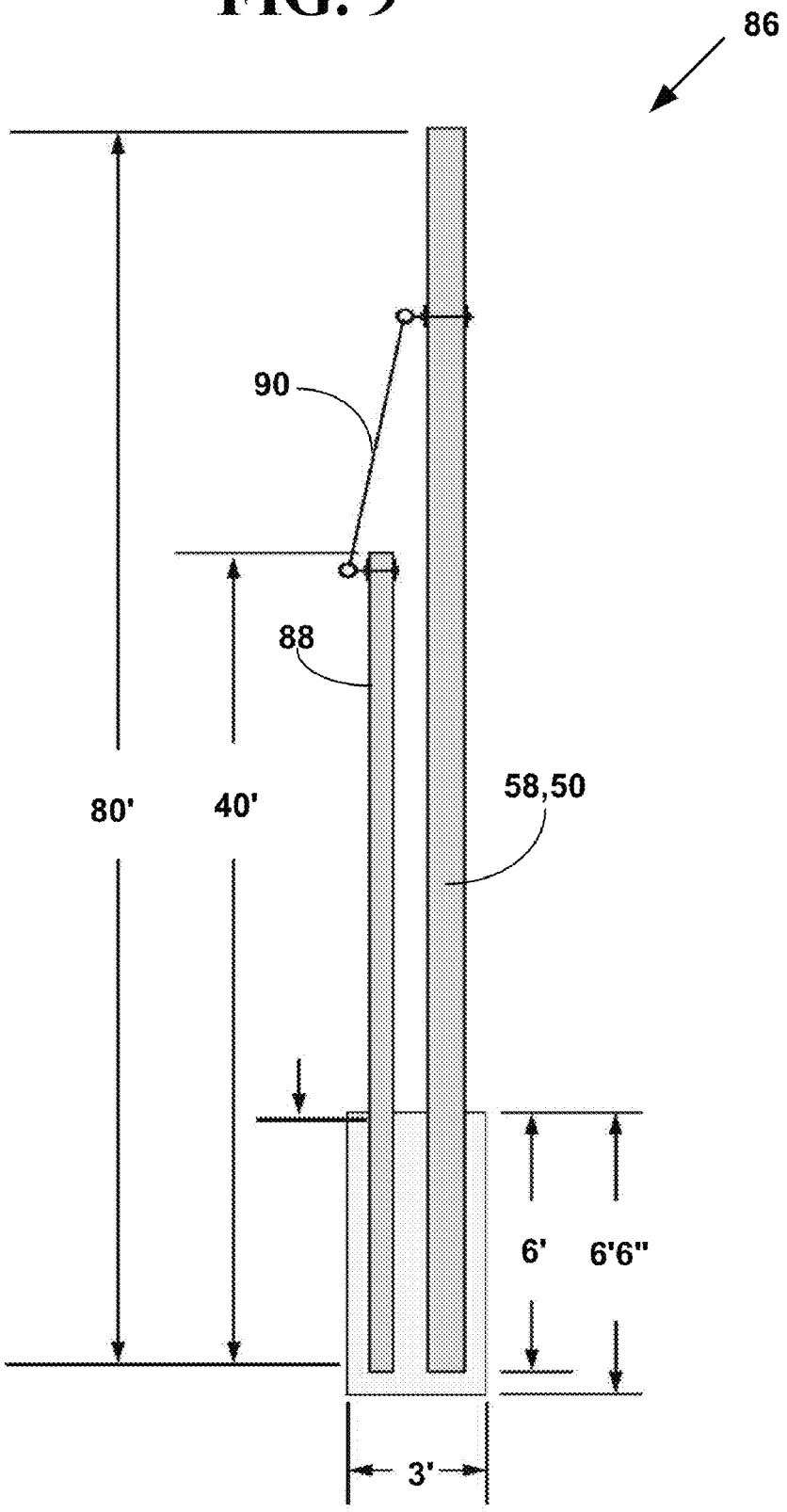
FIG. 9 is a block diagram illustrating an additional support component for the exemplary transmission support structure.

FIG. 9 is a block diagram 86 illustrating an additional support component 88 for the exemplary transmission support structure 56. The additional support component 88 may be used with first leg component 58 and/or second leg component 60 to provide additional support. The additional support component 88 provides additional lateral and medial support to the utility line support structure 56.

In one embodiment, the additional support component 88 is connected with a cable 90 via two eye bolts that are through bolted 84 through the legs 58, 60 and the additional support component 88. The cable can be metal, a composite material or other materials. However, the present invention is not limited to this embodiment and other types of attachments can also be used to practice the invention.

In one embodiment, the additional support component 88 includes extruded and pultruded hollow cylindrical components 10, 50. However, the present invention is not limited to this embodiment and types of structures in other size and shapes can also be used for the additional support component 88 (e.g., metal , wood, composite material, etc.).

In one embodiment, the additional support component 88 and the legs 58, 60 are placed 3 feet apart in an earth surface and embedded into concrete to a depth of 6 feet and/or 6 feet 6 inches to provide additional support. However, the present invention is not limited to this embodiment and other types of materials and embedding depths can also be used to practice the invention.

In one embodiment, the additional support component 88 can also be placed next to a single transmission pole 82. In another embodiment, the additional support component 88 is used to allow a the structure 56 or the single transmission pole 82 to be used as dead-end on a transmission line sequence. Dead-end towers have other differences from suspension towers as they are built stronger, they often have a wider base, and they often have stronger insulator strings to withstand the forces associated with the an end of transmission line sequence.

Figure 10:
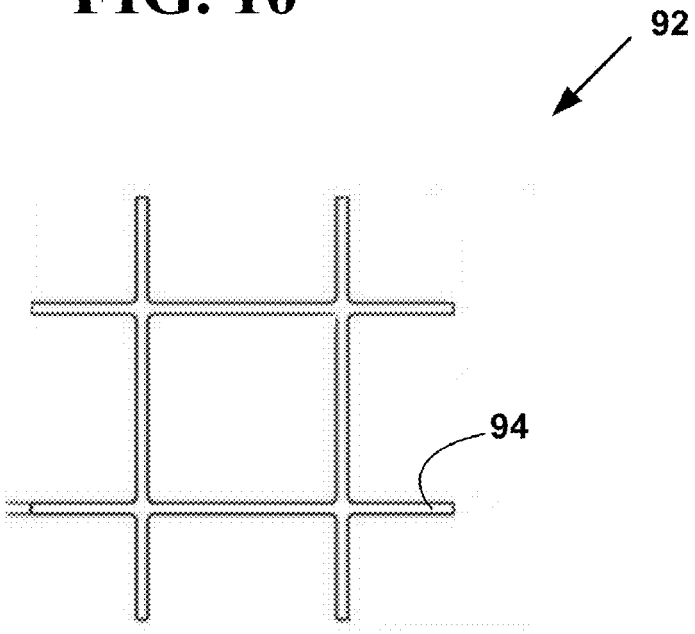
FIG. 10 is a block diagram illustrating an internal support component for an exemplary transmission support structure.

FIG. 10 is a block diagram 92 illustrating an internal support component 94 for an exemplary transmission support structure 56. The internal support component 94 provides additional tensional and torsional strength. In one embodiment, the internal support structure comprises the composite or plastic material including re-enforcing fibers as was described above for the extruded and/or pultruded components. In another embodiment, the integral support structure is made from a different material than the extruded and/or pultruded components. In one embodiment, the internal support component 94 (i.e., integral and/or removable) also includes integral copper wires, other metal wires so the internal support component can act as an antenna.

Figure 11:
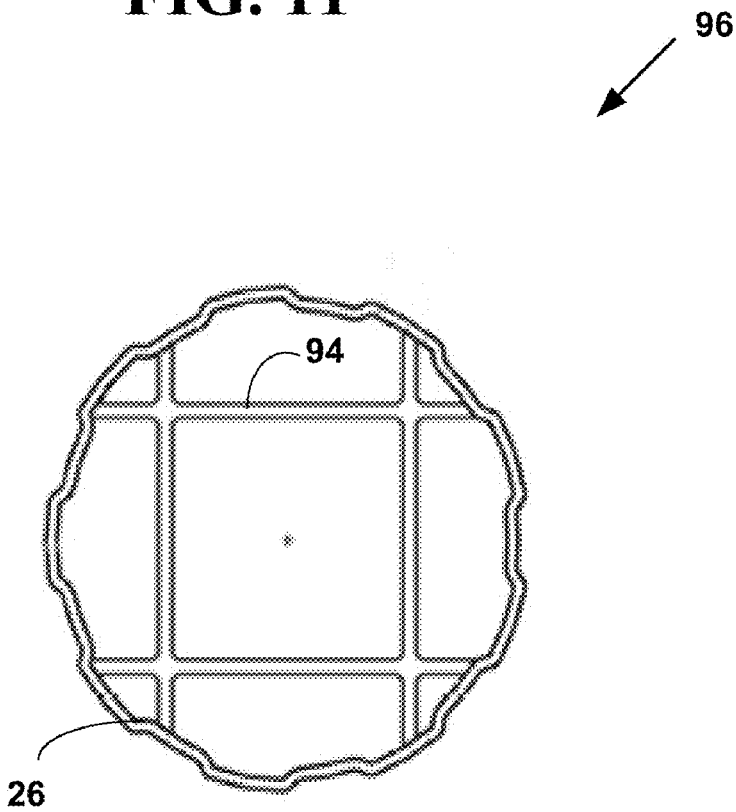
FIG. 11 is a block diagram illustrating an internal support component for an exemplary transmission support structure within pultruded hollow cylindrical component.

FIG. 11 is a block diagram 96 illustrating an internal support component 94 for an exemplary transmission support structure within pultruded hollow cylindrical component 50.

FIG. 11 illustrates the internal support component 94 within pultruded hollow cylindrical component 50 with structure 26. However, the same internal support component 94 is also used within extruded hollow cylindrical component 10 with structure 15 in a similar manner.

The internal support structure 94 provides additional lateral support (i.e., support for sideways movement) and medial (i.e., support for middle movement) support for the transmission structure 56.

In one embodiment, the internal support structure 94 is manufactured as an integral component of the extruded and pultruded hollow cylindrical components 10, 52. In another embodiment, the internal support structure is a separate removable component that is physically inserted into the extruded and pultruded hollow cylindrical components 10, 52.

In addition to support, the internal support structure 94 also provides plural separate channels in which wires and/or cables can be placed inside the extruded and pultruded hollow cylindrical components 14, 24. This prevents exposure of the wires and cables to the weather and makes the structure 56 more aesthetically appealing when viewed. In addition, the separate channels also provide insulation and help prevent electromagnetic interferences from electrical and magnetic currents generated by the wires and/or cables being used inside the hollow cylindrical components. Otherwise, electrical and magnetic currents generated by such wires and/or cables cause electrical and magnetic disturbances that may interrupt, obstruct, or otherwise degrade or limit the effective performance of an electrical circuit.

In one embodiment, the structure 56 includes both external electric transmission components for transmitted electricity and internal antenna components for telecommunications.

Attachable/Detachable Climbing Components

FIG. 12 is block diagram 98 illustrating an attachable/detachable climbing component 100 used on the exemplary utility line support structure 56. In the normal course of business, it is often necessary to allow maintenance workers to climb the extruded and pultruded hollow cylindrical components 10, 52 that make up the utility line support structure 56.

However, due to the shape of the cylinders and the material they are made of, conventional methods of free-climbing and/or climbing with lineman's spikes cannot be used. As a result, in one embodiment, the utility line support structure 56 includes an attachatable/detachable climbing component 100 that is used to climb on the structure.

Plural attachable/detachable climbing components 100 are used to create a base for a climbing ladder and/or for inserting climbing pegs. In one embodiment, the attachatable/detachable climbing component 100 comprises metal, plastic, rubber, wood, composite materials, or other materials.

In one embodiment, the attachatable/detachable climbing component 100 is through bolted 84 through pre-dilled holes in the structure 56. In another embodiment, the attachatable/detachable climbing component 100 is attached externally to the structure 56 without through bolting 84 and without using any pre-drilled holes and includes another type of tightening bolt 102 that is used to pressure tighten the attachatable/detachable climbing component 100 to the structure 56. Only two tightening bolts 102 are illustrated in FIG. 12. However, more or fewer tightening bolts may also be used to practice the invention.

The attachatable/detachable climbing component 100 includes plural climbing receptacles 104 that engage climbing components such as climbing pegs, climbing ladder rungs, etc. FIG. 12 also includes an exemplary attachment pattern 106 for attaching a climbing ladder typically used for transmission poles and/or legs of transmission towers. However, the present invention is not limited to such an attachment pattern 106 and other attachment patterns can also be used to practice the invention.

In one embodiment, the pultruded hollow cylindrical components 24, 53, and components of structure 56 including pultruded structure 52 comprise an overwrapping transverse winding process, a pullwinding process, that combines continuous filament winding with pultrusion to produce a pultruded hollow cylindrical structure with the shape of hollow cylindrical structure 50 that is used in structure 56. (See FIG. 18 and related text).

This "pullwinding" process incorporates longitudinal reinforcements with helical-wound layers, providing maximum tensil strength, torsional strength and hoop strength. As is known in the art, the "tensile strength" is a maximum stress that a material can withstand before necking As is known in the art "necking" is a mode of deformation where relatively large amounts of strain localize disproportionately in a small region of an object. As is known in the art, "hoop strength" includes strength against a circumferential stress in a cylindrically shaped part as a result of an internal or external pressure and "torsional strength" is a strength against a twisting of an object due to an applied torque in a cylindrically shaped object, the resultant shearing stress is perpendicular to a radius of the object.

In one embodiment, the pultruded hollow cylindrical components are formed using a self-contained inline winding unit with a pultrusion machine is used feeding angled fibers between layers of unidirectional fibers before curing in a pultrusion die. The longitudinal fibers are used for axial and bending resistance while hoop fibers are used for hoop tension and compression resistance. The pullwinding equipment is comprised of twin winding heads which revolve in opposite directions over a spindle. However, the present invention is not limited to such an embodiment and other embodiments can also be used to practice the invention. (See FIG. 15).

The components of structure 56 allow transmission towers to be designed easier, manufactured cheaper, installed easier and quicker and maintained easier than those made of other material such as steel, other metals, wood, etc.

Apparatus for Transporting and Raising Pultruded/Extruged Structures

Even though the extruded and/or pultruded hollow cylindrical components 10, 52, 56, 82 are lighter than conventional utility poles and/or steel components for utility transmission structures, they are still difficult to transport, handle and install due to their long lengths. As a result, an apparatus for transporting, raising and pultruded/extruded structures 10, 52, 56, 82 is presented. The apparatus is made from the same materials as the extruded structures 10, 52, 56, 82 and provides the same strengths, resistances etc. as the components themselves.

The apparatus is lightweight and can be used on paved surfaces as well as off-road surfaces. The apparatus safely transports pultruded/extruded structures 10, 52, 56, 82 and includes a moveable boom that allows the pultruded/extruded structures to be raised into place and installed on virtually any type of terrain and virtually any slope.

Figure 13:
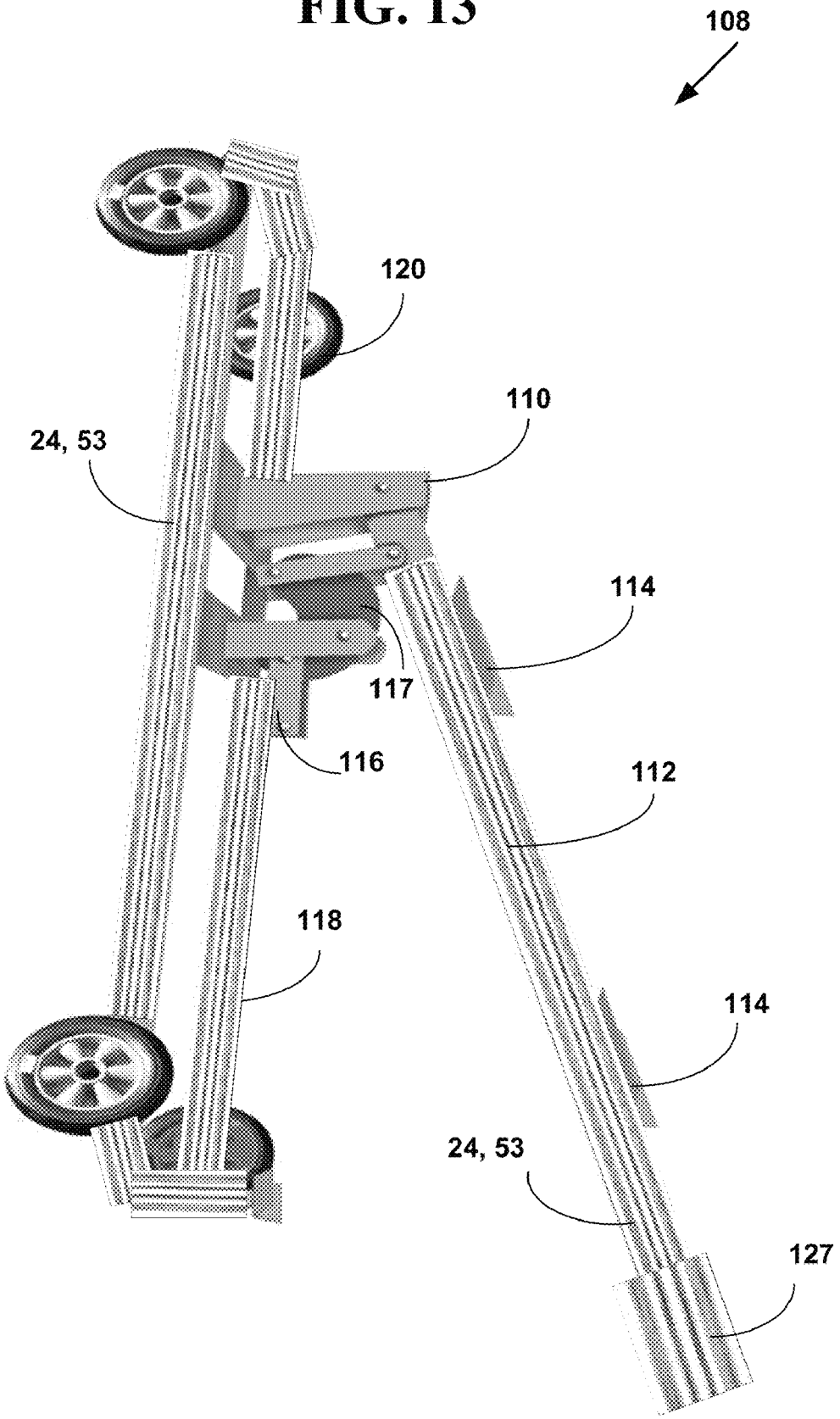
FIG. 13 is a block diagram illustrating an apparatus that does not include any power source and needs to be pulled with a vehicle or via a human puller.

FIG. 13 is a block diagram 108 illustrating an apparatus 110 for transported, raising and installing pultruded and/or extruded structures 10, 52, 56, 82. The apparatus 110 includes a moveable boom 112 with plural structure engaging components 114. The moveable boom 112 provides a range of movement from a horizontal position to a vertical position and moves between the angles of at least zero degrees (e.g., horizontal, etc.) and at least 90 degrees (e.g., vertical, etc.). However the present invention is not limited to these angles and other angles can also be used to practice the invention. The horizontal position is used to transport the extruded and/or pultruded hollow cylindrical components 10, 52, 56, 82 to a desired site. The vertical position is used to install the extruded and/or pultruded hollow cylindrical components 10, 52, 56, 82 into a desired position such as a mounting hole (e.g., filled with wet concrete, etc.) at the desired site.

In one embodiment, the moveable boom 112 comprises a hollow pullwound pultruded cylindrical structure with an internal support structure 94. for providing additional tensional, torsional strength and hoop strength to the moveable boom 112.

The plural engaging components 114 engage extruded and pultruded hollow cylindrical components 10, 52, 56, 82 in plural places to prevent the extruded and pultruded hollow cylindrical components 10, 52, 56, 82. from rolling off the apparatus 110. Two engaging components are illustrated in FIG. 13. However, the present invention is not limited to this embodiment and more, fewer or other types of engaging components can also be used.

The apparatus 110 further includes a boom movement component 116. In one embodiment, the boom movement component 116 is a mechanical boom component that includes plural levers and at least one selectable and changeable counter weight 117 that allows the boom movement component 116 to move the boom 112 from a horizontal position to a vertical position when activated.

As is known in the art, counterweights often used in traction lifts, elevators cranes, etc.. In these applications, an expected load multiplied by a distance that load will be spaced from a central support (called the "tipping point") and is equal to a counterweight's mass times its distance from the tipping point in order to prevent over-balancing either side. This distance times mass is called the "load moment."

In one embodiment, the one or more counterweights 117 for the boom movement component 116 are selectable/changable/removable/attachable and are configured and change based on a weight of a extruded and pultruded hollow cylindrical components 10, 52, 56, 82 used. For example, a first extruded and pultruded hollow cylindrical components 10, 52 at a thirty foot length would be configured with a first counterweight 117 and a second extruded and pultruded hollow cylindrical components 10, 52 at an eighty foot length would be configured with a second heavier counterweight 117' because the second extruded and pultruded hollow cylindrical components 10, 52 is a heavier weight.

The boom 112 is used to install extruded and pultruded hollow cylindrical components 10, 52, 56, 82 into a vertical position. For example, the boom 112 may be used to install an extruded and pultruded hollow cylindrical components 10, 52, 56, 82 at an angle between at least zero degrees and at least 90 degrees when an extruded and pultruded hollow cylindrical components 10, 52, 56, 82 is used on a surface that is sloped, is used as a dead-end component, etc.

In one embodiment, the moveable boom 112 comprises a first hollow pullwound pultruded cylindrical structure with a first smaller radius connected to boom movement component 116. A second hollow pullwound pultruded cylindrical structure 127 (FIG. 13) with a second larger radius is placed over the first hollow pullwound pultruded cylindrical structure for providing additional tensional, torsional strength and hoop strength to the moveable boom 112. The unique shape of repeating inner and outer surfaces of the hollow pullwound pultruded cylindrical structures provide an inter-locking that prevents movement and/or slippage of the structures and also prevents the hollow pullwound pultruded cylindrical structures from disengaging from each other. In such an embodiment, one or more additional counter weights 117 of heavier weight would be used.

In one embodiment, a set of additional hollow pullwound pultruded cylindrical structures with progressively larger radiuses is used. This set of additional hollow pullwound pultruded cylindrical structures allows the apparatus 110 to lift and lower progressively larger, longer and heavier pultruded and/or extruded structures.

The apparatus 110 further includes a support frame 118 for supporting the boom 112 and the boom movement component 116 and plural wheels 120.

In one embodiment, the support frame 118 comprises a hollow pullwound pultruded cylindrical structure with an internal support structure 94. for providing additional tensional, torsional strength and hoop strength to the support frame 118.

The plural wheel 120 are illustrated with smooth tires. However, the present invention also includes an apparatus 110 with all-terrain tires and various combinations of tires. The all-terrain tires include all rubber tires and/or tires with spikes made from metals, composite materials and other materials.

In one exemplary embodiment, the boom 112 and the support frame 118 (FIG. 13) comprise extruded and/or pultruded hollow cylindrical components 10, 24, 52, 56, 80, etc. In another embodiment, the apparatus 110 includes only the boom 112 comprising extruded and/or pultruded hollow cylindrical components 10, 24, 52, 56, 82 components. In another embodiment, In another embodiment, the apparatus 110 includes only the support frame 118 comprising extruded and/or pultruded hollow cylindrical components 10, 24, 52, 56, 82 components. In another embodiment, the apparatus 110 includes only selected portions of the support frame 118 (e.g., FIG. 14) comprising extruded and/or pultruded hollow cylindrical components 10, 24, 52, 56, 82 components. However, the present invention is not limited to this embodiment and other embodiments can also be used to practice the invention.

In another exemplary embodiment, the components of the apparatus 110 comprise light weight metals such aluminum, titanium, composite materials or other materials. In another embodiment, the apparatus 110 comprises steel components. However, the present invention is not limited to this embodiment and other materials and other embodiments can also be used to practice the invention.

In one exemplary embodiment, the plural wheels 120 include rubber tires. In another exemplary embodiment, the plural wheels 120 include tires made from wire, composite materials or other materials. In another exemplary embodiment, the plural wheels 120 include oversized, tires such as those used on swamp buggies in wet areas, such as swamps, bogs, tundra, etc. However, the present invention is not limited to these embodiments and other embodiments and other types of tires can also be used to practice the invention.

The apparatus 110 is light enough in weight, including pultruded/extruded structures 10, 24, 52, 56, 82 to be easily pushed and/or pulled behind a vehicle or pushed and/or pulled by a human puller.

FIG. 13 illustrates an apparatus 110 that does not include any power transport means and needs to be pulled with a vehicle or via a human or an animal (e.g., horse, mule, etc.) and activated to raise pultruded/extruded structures 10, 24, 52, 56, 82.

Figure 14:
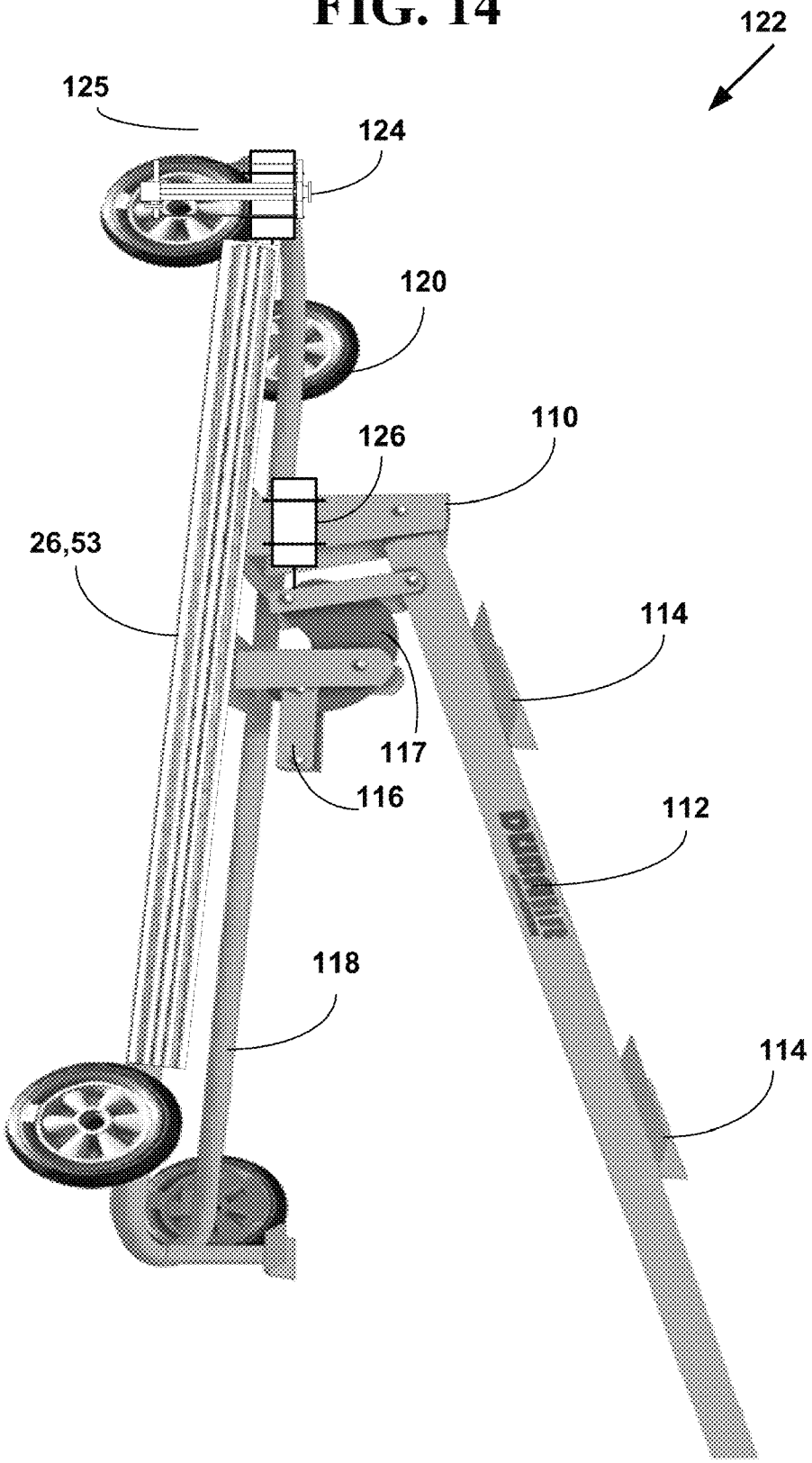
FIG. 14 is a block diagram illustrating an apparatus that includes a power source and does not need to be pulled with a vehicle or via a human puller.

FIG. 14 illustrates an apparatus 122 that includes a power transport means 124 and does not need to be pulled with a vehicle or via a human puller. In one embodiment, the power transport means 124 includes an electric power source with one or more batteries, plural capacitors in which electrical currents are stored and generated with a hand crank, an internal combustion power source that requires a natural gas, gasoline, diesel, hydrogen, etc. The power transport means 124 further includes gears, rollers 125, etc. to engage the plural wheels 120. However, the present invention is not limited to these embodiments and other embodiments and other types of power transport means can also be used to practice the invention.

In such an embodiment with a power transport means a technician is able to easily transport both the apparatus 110 and pultruded/extruded structures 10, 24, 52, 56, 82 in any type of terrain without hard physical activity or the need for a transport animal.

In another embodiment, the apparatus 110 includes the power movement means 124, but is transported by a vehicle (e.g., maintenance truck, etc.) near an installation site. Then the power movement means 124 is started to transport the apparatus 110 to an exact installation site where the transport vehicle may not be able to reach (e.g., slope, swamp, bog, tundra, etc.).

In another embodiment, the apparatus 120 includes a second power movement means 126 is connected to the boom movement component 116 to move make it easier to move the boom 112. In another embodiment, the apparatus 110 includes the second power movement means s126 to lower and raise the boom 112 but not the first power movement means 124 to move the plural wheels 120 of the apparatus. However, the present invention is not limited to these embodiments and other combinations and other embodiments and other types of power transport means can also be used to practice the invention.

Pultruded/Extruded Lighting Structures

Figure 15A:
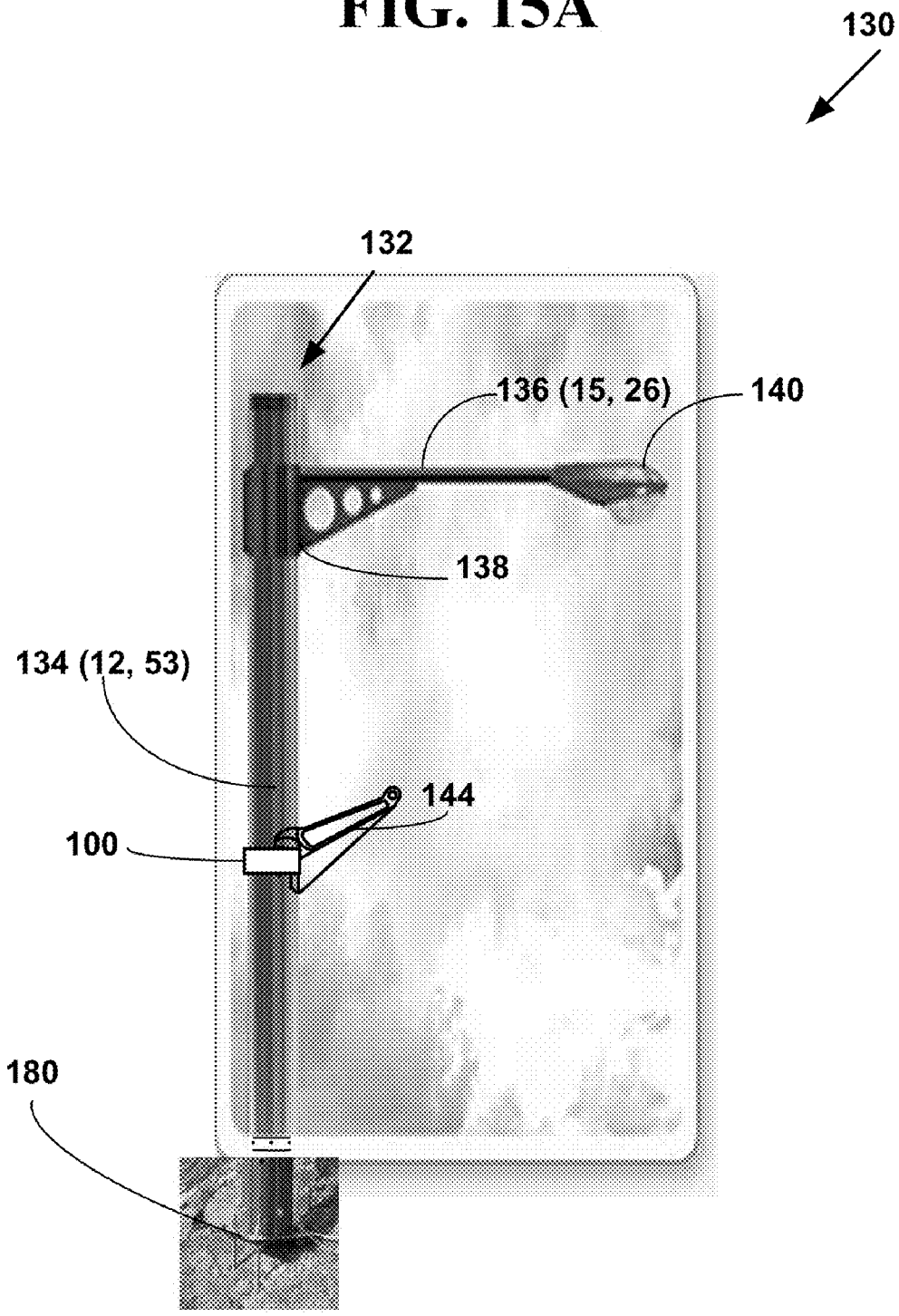
FIG. 15A is a block diagram illustrating a pultruded/extruded lighting structure.

FIG. 15A is a block diagram 130 illustrating a pultruded/extruded lighting structure 132.

Figure 20A:
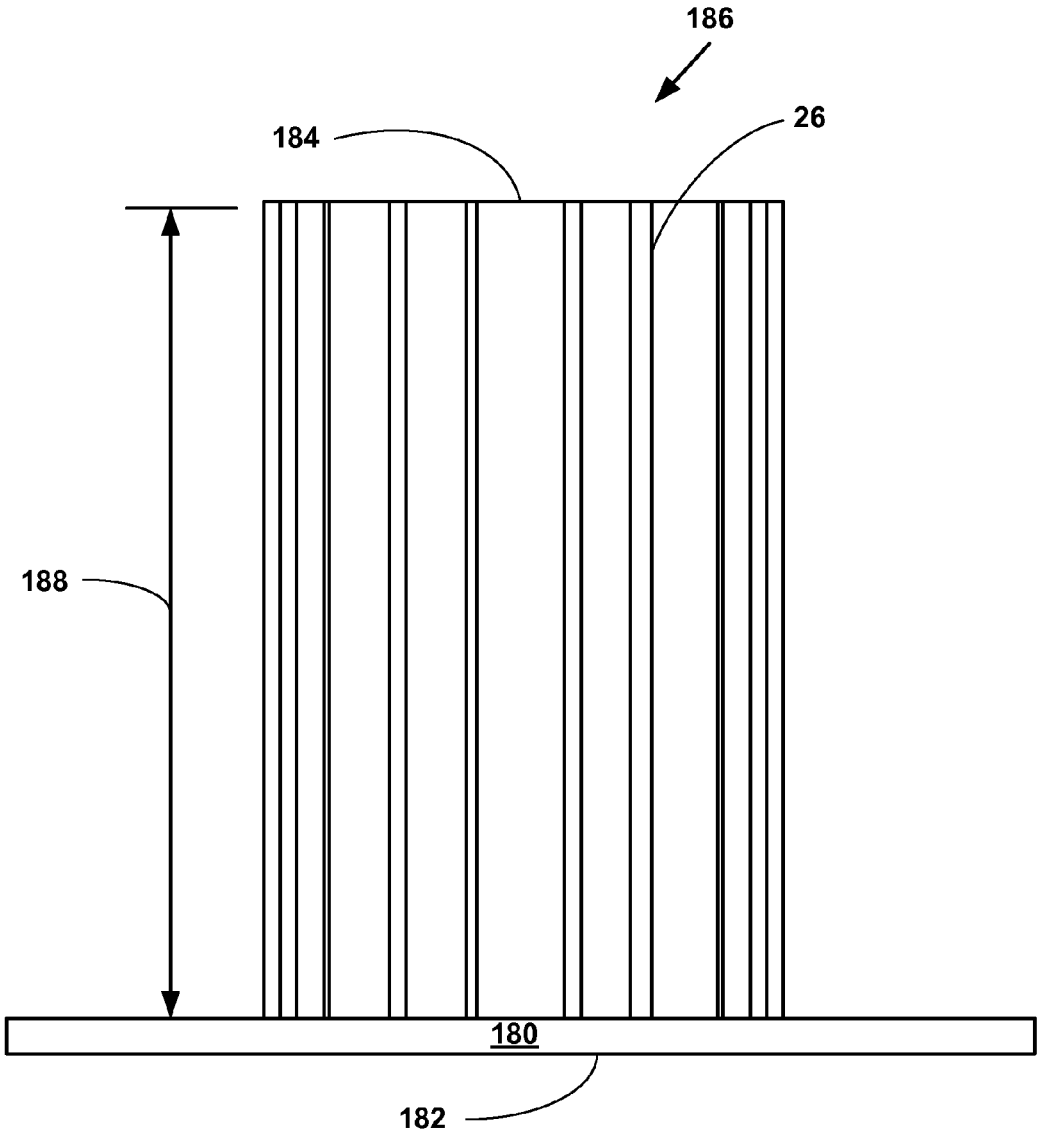
FIG. 20A is a block diagram of illustrating an perspective view of the exemplary pultruded/extruded mounting component.
Figure 20B:
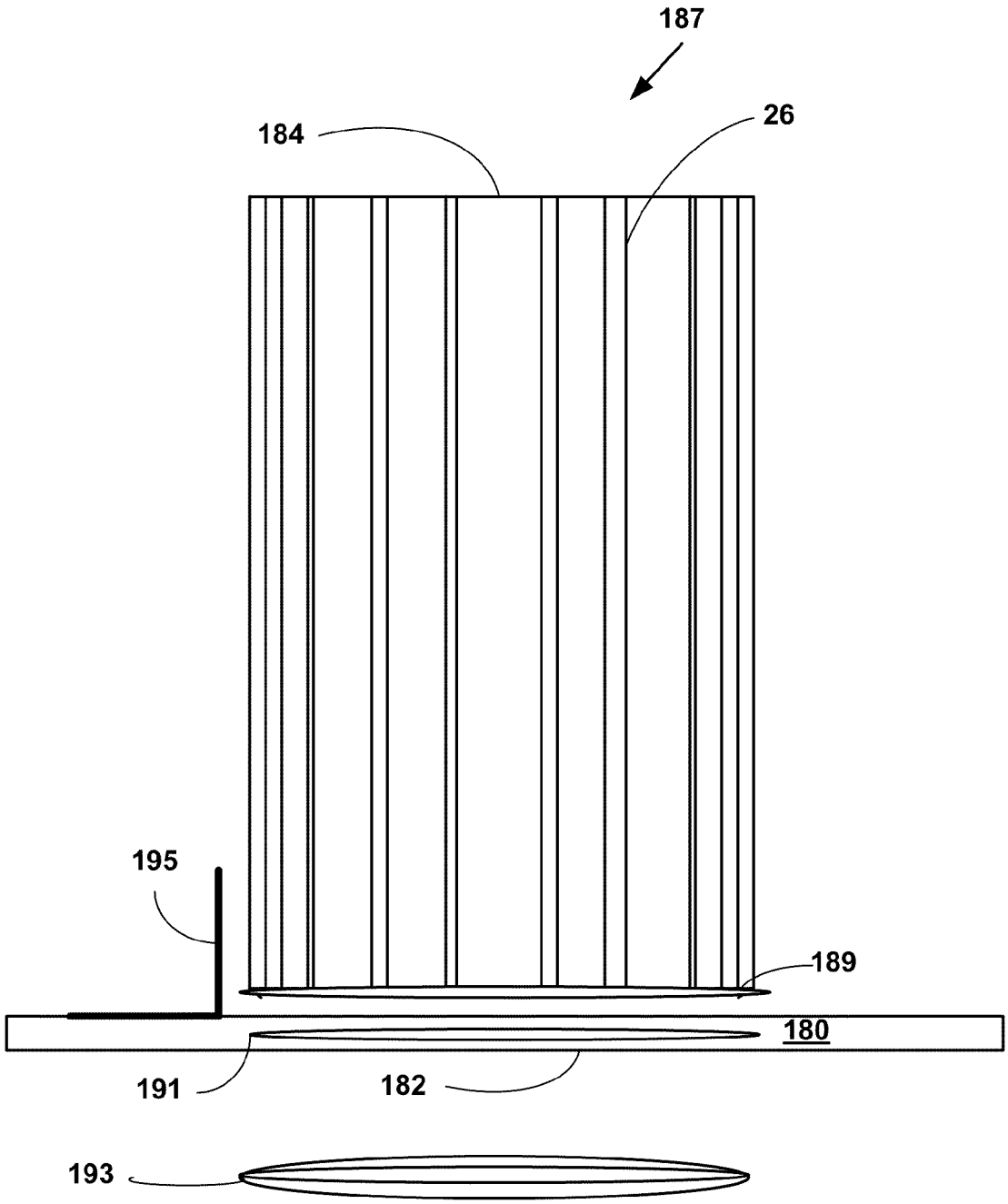
FIG. 20B is a block diagram of illustrating an perspective view an exemplary pultruded/extruded mounting component with a configurable removable vertical mounting component portion.
Figure 21:
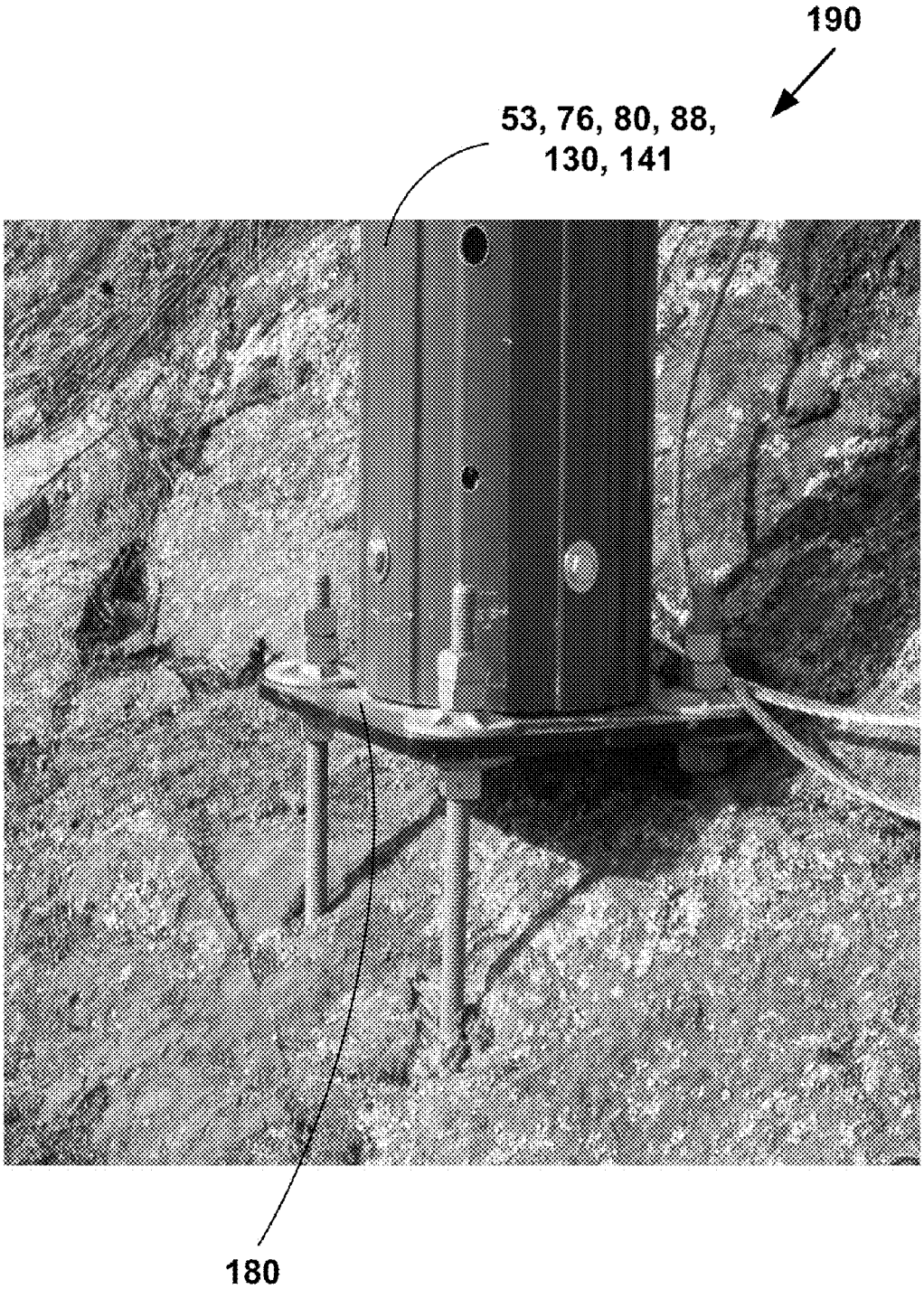
FIG. 21 is a block diagram of a digital photograph illustrating a perspective view of the exemplary pultruded/extruded mounting component attached to an uneven bedrock and a pultruded utility structure.

The pultruded/extruded lighting structures includes a vertical support component 134, a horizontal support component 136, a support frame component 138 a lighting component 140 and a mounting component 180 (FIGS. 19-21).

In one embodiment the vertical support component 134 includes a vertical pullwound pultruded cylindrical support component includes a pre-determined inner and outer shape and first diameter (e.g., FIGS. 3 and 4) for providing vertical support for the lighting structure 132 and allowing the lighting structure 132 to be attached to a surface (the ground, etc.). The pullwound pultruded cylindrical vertical support component 134 includes longitudinal reinforcements with a plurality of helical-wound layers, the plurality of helical-wound layers and pre-determined inner and outer shape providing maximum tensil strength, torsional strength and hoop strength. The vertical pullwound pultruded cylindrical support component is connected to a horizontal pullwound pultruded support component 136.

In one embodiment, the horizontal support component 136 includes a horizontal pullwound pultruded cylindrical support component with the same pre-determined inner and outer shape and a second radius and a second diameter for providing horizontal support for the lighting apparatus connected to the support bracket component 138 and to the lighting component 140.

In one embodiment, the second radius and the second diameter are smaller than the first radius and the first diameter (e.g., FIG. 4). In another embodiment, the second radius and the second diameter are equal to first radius and the first diameter.

Figure 15B:
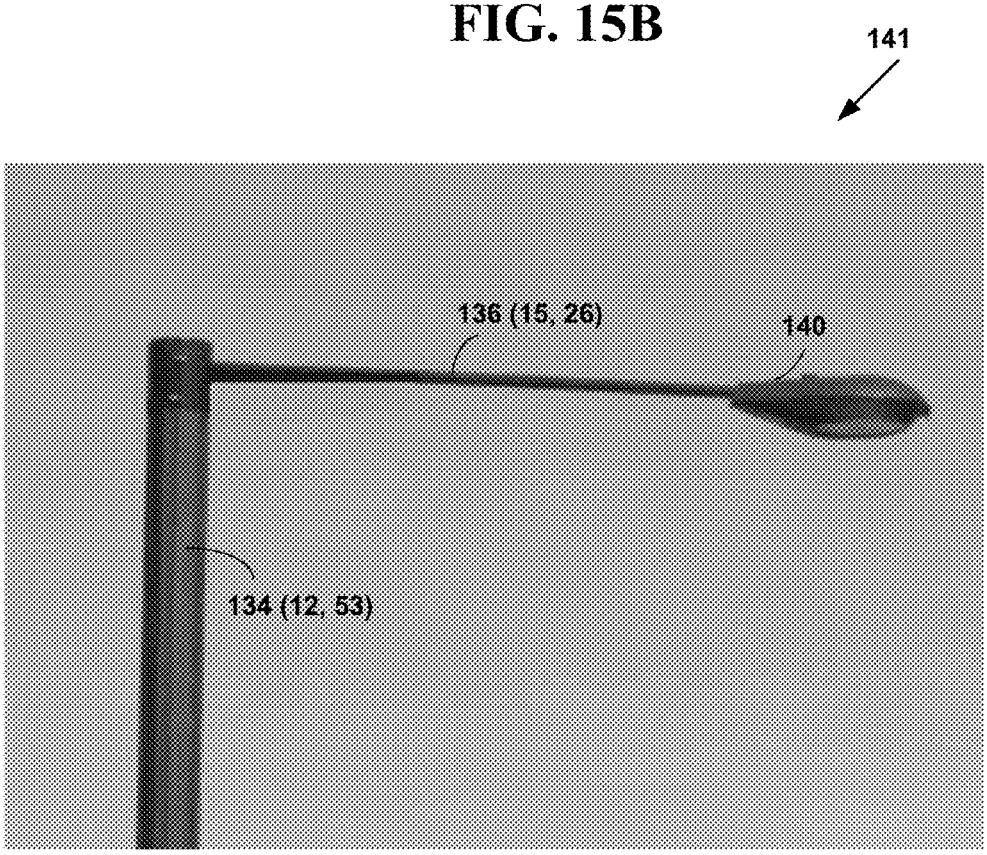
FIG. 15B is a block diagram illustrating another pultruded/extruded lighting structure.

FIG. 15B is a block diagram 141 illustrating another pultruded/extruded lighting structure 132. FIG. 15B illustrates the horizontal component 136 attached directly to the vertical component 134. In this embodiment, the support frame component 138 is not used.

In one embodiment, the vertical support component 134, the horizontal support component 136 comprising pultruded/extruded structures 12, 53. In such an embodiment, the vertical support component 134 includes lengths of about ten feet to about fifty feet or more. However, the present invention is not limited to these embodiments and other embodiments can also be used to practice the invention.

In one exemplary embodiment, the vertical component 134 includes a length of about 30.5 feet for use in residential areas. In one embodiment, the horizontal support component 136 includes a length of about five feet to about twenty feet. However, the present invention is not limited to these embodiments and other embodiments can also be used to practice the invention.

In one exemplary embodiment, the support frame component 138 includes flat extruded and/or pultruded materials with pultruded structures with a pullwound overwrapping transverse winding process that combines continuous filament winding as was described above. The transverse winding process provides tensile, flexural and compressive strength. In another embodiment, the support bracket component includes a flat section of a cylindrical pullwound pultruded structure that has been cut from such a structure. In such an embodiment, the flat section may include internal support components 94 in the cross-section.

In another embodiment, the support frame component 138 includes standard filament components without winding. In another exemplary embodiment, the support bracket component 138 includes metal, rubber, wood, composite material or other materials. However, the present invention is not limited to these embodiments and other combinations can also be used to practice the invention In another embodiment, the vertical support component 134 includes powder coated steel bases that are unique in design, and can retrofit to existing bolt patterns. The steel bases are engineered specifically to received and engage pultruded/extruded structures 12, 53. That is, the steel bases are slightly larger in diameter to receive and engage pultruded/extruded structures 12, 53 as was described above for leg components 74, 76 and 80 above. However, the present invention is not limited to these embodiments and other embodiments can also be used to practice the invention.

In one embodiment, the lighting component 140 includes a wired-powered, a solar powered, a battery powered or other powered lighting source. The lighting source includes induction lamps, incandescent lamps, fluorescent lamps, mercury vapor lamps, high-pressure sodium lamps, metal halide lamps, light-emitting-diode (LED) lamps, etc. However, the present invention is not limited to these embodiments and other embodiments can also be used to practice the invention.

The lighting component 140 is illustrated as a tear-drop shape. However, the present invention is not limited to this shape and the lighting component can be round, square and other shapes.

In another embodiment, the pultruded/extruded lighting structure 132 includes only the vertical component 134 and the lighting component 140. In such an embodiment, the lighting component is placed directly on top of the vertical component 134. However, the present invention is not limited to these embodiments and other embodiments can also be used to practice the invention.

In another embodiment, the horizontal component 136 is attached at a right angle to the vertical component 134. In another embodiment, the horizontal component 136 is attached at an angle other than a right angle to the vertical component 134. In such an embodiment, an pultruded/extruded structures 10, 52 that comprises the horizontal component is bent into an arc support structure. However, the present invention is not limited to these embodiments and other embodiments can also be used to practice the invention.

In one embodiment, any wires used to provide power to the lighting component 140 are fed through the hollow portions of the vertical component 134 and the horizontal component 136 so the wires are protected from the environment and from tampering, are safer and more aesthetically pleasing as they are not visible.

The pultruded/extruded lighting structure 132 is used for: (1) street lighting; (2) area lighting; (3) decorative lighting; (4) lighting bracket arms for (1)-(3), and (5) custom fabrication lighting for (1)-(3).

Removable Climbing Components for Pultruded/Extruded Structures

FIGS. 16A and 16B are block diagrams 142, 150 illustrating pultruded/extruded climbing components. In FIG. 16A, the climbing component includes a foot/hand peg 144 with a primary attachment component 146 including a primary receptacle means for attaching the foot/hand peg 144 to the bracket component 152 inserted into one of the plural climbing receptacles 104 included in attachable/detachable climbing component 100. The foot/hand peg 144 allows a maintenance worker and/or technician to climb the pultruded/extruded structures 10, 24, 52, 56, 82, 130, 141 by creating a temporary, removable ladder and/or climbing structure.

In one embodiment, the foot/hand peg 144 includes a metal, composite material, rubber, plastic, pultruded materials, pullwound pultruded materials, extruded materials or other materials foot/hand peg. In one exemplary embodiment, the foot/hand peg 144 includes a steel foot/hand peg 144. However, the present invention is not limited to these embodiments and other embodiments can also be used to practice the invention.

In one embodiment, the foot/hand peg 144 includes a secondary receptacle means 148. The secondary receptacle means includes secondary attachment component 148 allows the foot/hand peg 144 to be directly attached to attachable/detachable climbing component 100 of FIG. 12. However, the secondary attachment component 148 is not necessary to practice the invention if the attachment mounting bracket 150 of FIG. 16B is used. In such an embodiment, the foot/hand peg 144 slides directly into one of the plural climbing receptacles 104 (FIG. 12) and engages the climbing receptacle 104 via the secondary attachment component 148. This securely anchors the foot/hand peg 144 in the climbing receptacle 104.

In such an embodiment, the invention can be practice without the attachment bracket component 150 illustrated in FIG. 16B if an attachable/detachable climbing component 100 of FIG. 12 is used. However, the present invention is not limited to such an embodiment and the foot/hand peg 144 can be used without the secondary attachment component 148 with the attachment bracket component 150 of FIG. 16B instead.

In FIG. 16B, the climbing component further includes a bracket component 152. The a bracket component 152 includes plural attachment protrusions 154 (two of which are illustrated) and a bracket attachment component 156. The bracket component 152 is specifically sized, angled and shaped to fit over one of the plural rib faces 16, or within of the plural angular faces 18 of the extruded structure 10, or over one of the plural protruding components 28 or within one of the plural intruding components of the pultruded structure 52 and/or other components of structure 56.

In one embodiment the bracket attachment component 156 is used to attach the bracket component 152 via pre-dilled holes in the pultruded/extruded structures 10, 52 and/or structure 56. In another embodiment, the bracket attachment component 156 is used to attach the bracket component 152 via new holes drilled into the pultruded/extruded structures 10, 52 and/or structure 56 by a maintenance worker or technician who desires to provide attachment points for a climbing ladder. An attachment means (e.g., screw, bolt, peg, nail, fastener, etc.) is used to attach the bracket component 152 via the bracket attachment component 156.

In such an embodiment, after attaching the bracket component 152 to the pultruded/extruded structures 10, 52 and/or structure 56, 130, 141 the foot/hand peg 144 is attached to the plural attachment protrusions 154 via the primary attachment component 146 thereby providing a hand grip and/or a ladder foot pad for climbing.

In such an embodiment, the bracket component 152 is permanently placed on the pultruded/extruded structures 10, 52 and/or structure 56 in a pre-determined pattern (e.g., that illustrated in FIG. 12 for the attachable/detachable climbing component 100, etc.) and are left on the pultruded/extruded structures 10, 52 and/or structure 56.

Therefore a maintenance worker and/or technician can insert and remove the foot/hand peg 144 to provide a temporary ladder and/or climbing structure to use for maintenance, etc. When the maintenance, etc. is completed, the foot/hand pegs 144 are removed but the bracket components 152 are left on the pultruded/extruded structures 10, 52 and/or structure 56 for the next maintenance visit when the foot/hand pegs 144 are temporarily reattached.

Figures 17A, 17B:
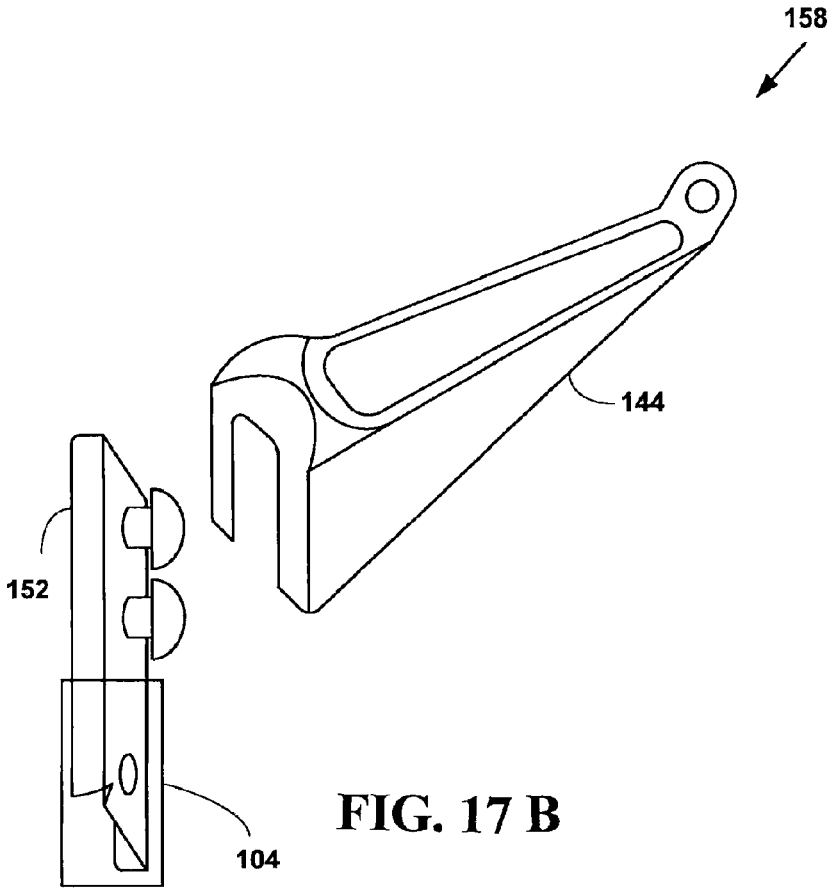
FIGS. 17A & B are block diagrams illustrating one exemplary connection of pultruded/extruded climbing components.

FIG. 17 is a block diagram 158 illustrating one exemplary connection of pultruded/extruded climbing components.

In one embodiment, a bracket component 152 slides into one of the plural climbing receptacles 104 (FIG. 12) upside down with the a bracket attachment component 156 side down leaving the plural attachment protrusions 154 exposed and available for attaching the foot/hand peg 144 via the primary attachment component 146. This allows the foot/hand peg 144 to be firmly attached to the bracket component 152 and also the receiving the climbing receptacle 104 of attachable/detachable climbing component 100. In such an embodiment, if the attachable/detachable climbing component 100 is already installed the foot/hand peg 144 can be used alone if it includes the secondary attachment component 148 or used with the bracket component 152 if the foot/hand peg 144 does not include the secondary attachment component 148. In such an embodiment, the attachment bracket component 148 is not fastened directly to the pultruded/extruded structures 10, 52 and/or structure 56 and the bracket attachment component 156 is not used.

The climbing structures described herein can be used with any of the pultruded/extureded structures described herein.

Pullwinding Machine

Figure 18:
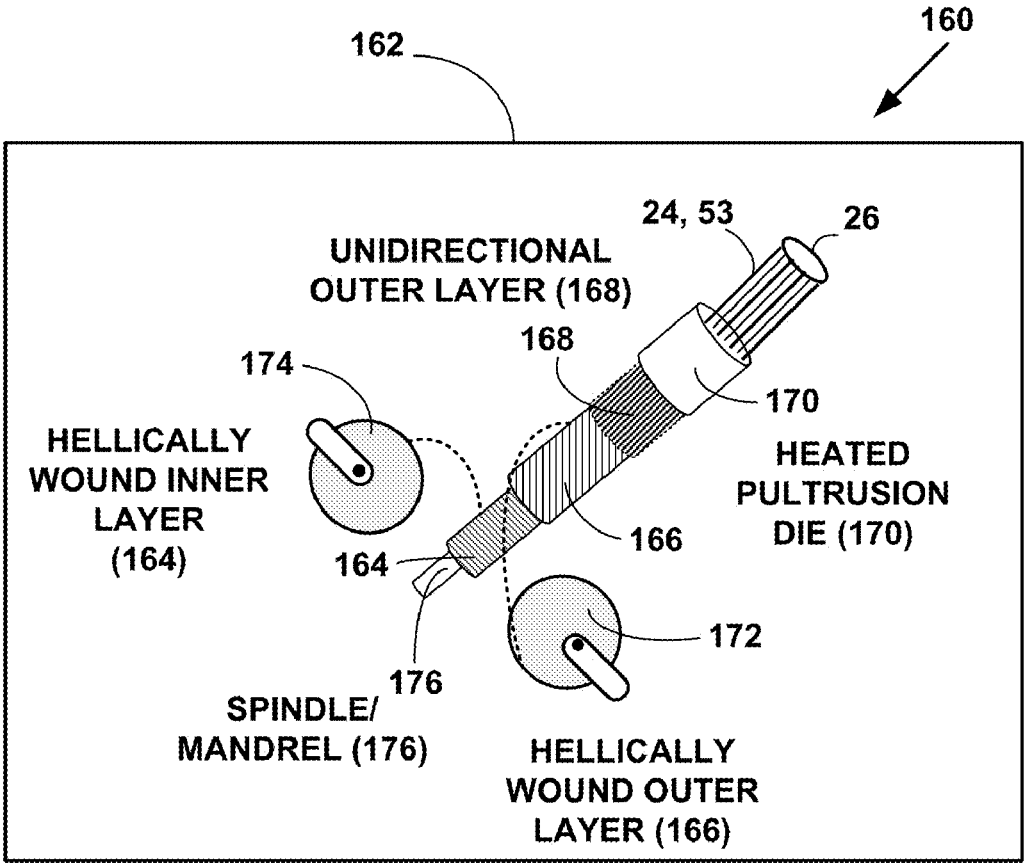
FIG. 18 is a block diagram illustrating an exemplary pull winding, pultrusion process used to create pullwound pultruded structures.

FIG. 18 is a block diagram 160 illustrating an exemplary pull winding, pultrusion process used to create pullwound pultruded structures for the present invention.

In one embodiment, the pullwound pultruded hollow cylindrical components (e.g., 24, 53, 56, 58) are formed using a self-contained inline winding unit with heat pultrusion included in a single machine 162. The machine 162 feeds angled fibers 164, 166 between layers of unidirectional fibers 168 before curing in a heated pultrusion die 170. The longitudinal fibers 168 are used for axial and bending resistance while hoop fibers 164,166 are used for hoop tension and compression resistance. The pullwinding equipment is comprised of twin winding heads 172, 174 which revolve in opposite directions over a spindle or mandrel 176. The spindle or mandrel 176 is removed leaving a hollow pullwound pultruded cylindrical component.

Pultruded/Extruded Mounting Components

Figure 19A:
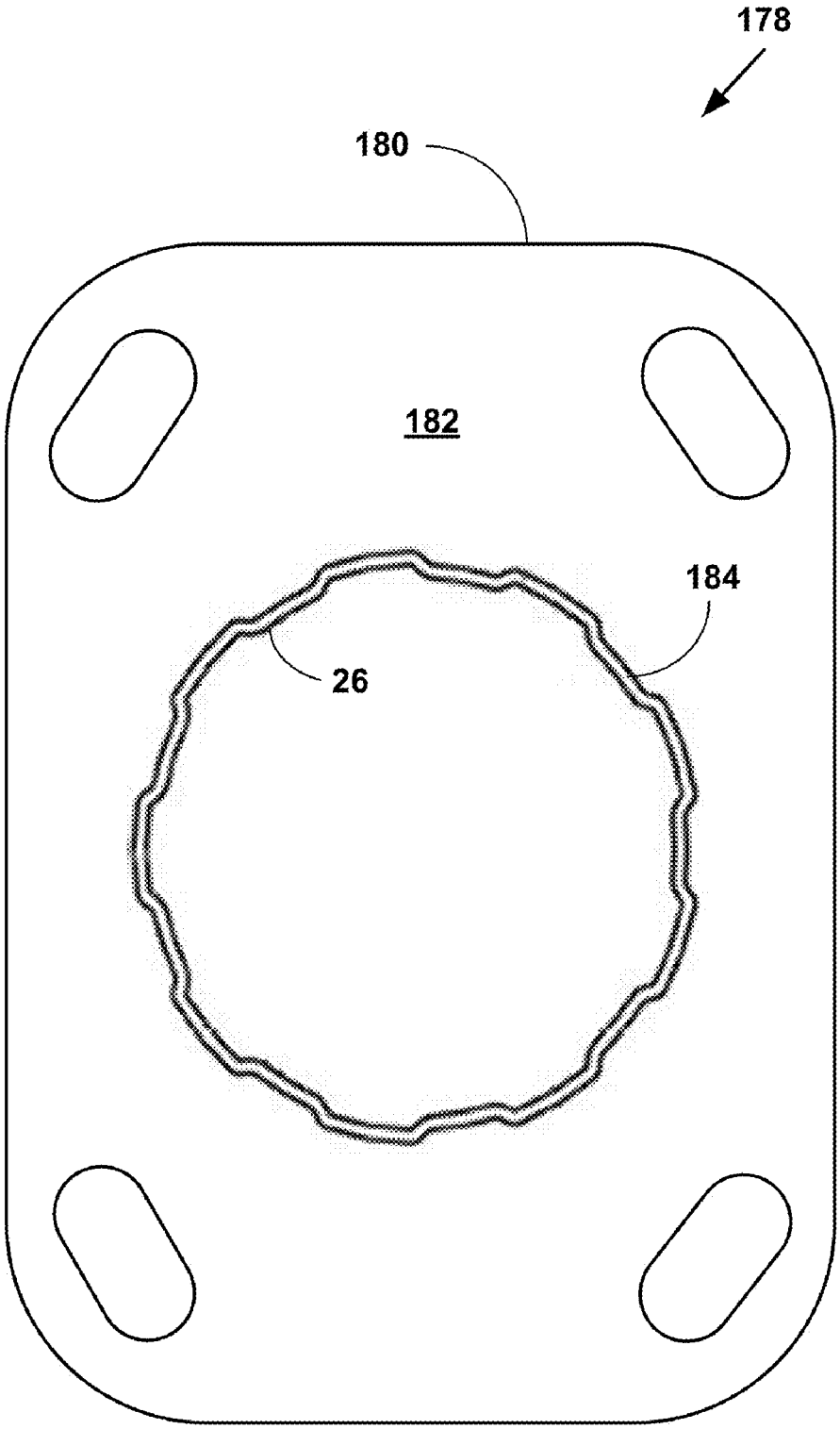
FIG. 19A is a block diagram illustrating a top view of an exemplary pultruded/extruded mounting component.

FIG. 19A is a block diagram illustrating a top view 178 of an exemplary pultruded/extruded mounting component 180. The exemplary mounting component 180 includes a horizontal mounting component portion 182 and a vertical mounting component portion 184. The exemplary mounting component 180 can be used to attach any of the extruded and/or pultruded structures described above. However, in the present invention, the exemplary mounting component 180 is used to attach a pullwound pultrided lighting structure 130, 141 to a surface. However, the present invention is not limited to this embodiment, and the mounting component 180 can be used to practice other embodiments of the invention.

FIG. 19A illustrates an exemplary mounting component 180 with four oval mounting holes 181. However, the present invention is not limited to this embodiment, and more fewer and other shaped mounting holes can also be used to practice the inventions.

Figure 19B:
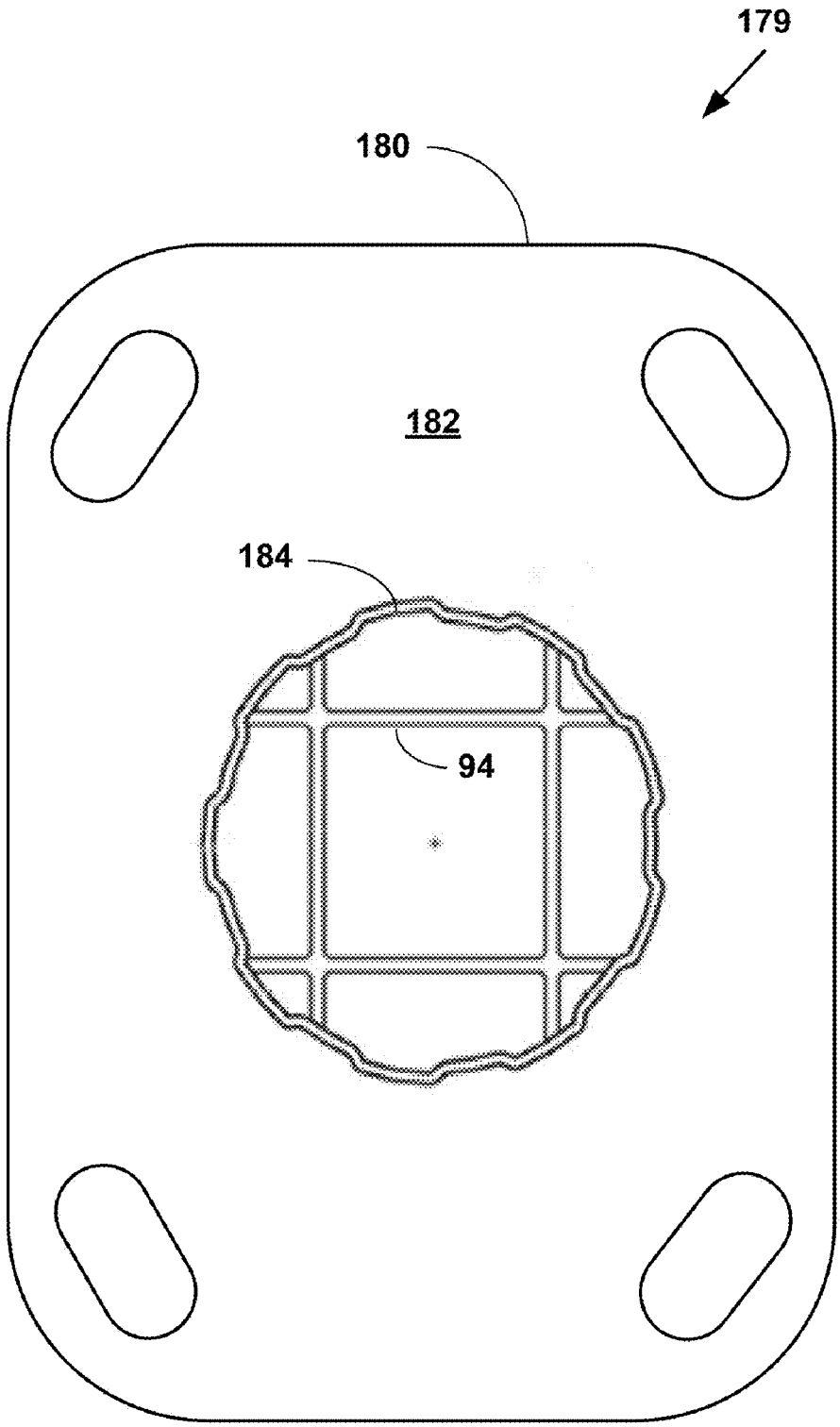
FIG. 19B is a block diagram illustrating a top view of an exemplary pultruded/extruded mounting component with internal support component of FIG. 11.

FIG. 19B is a block diagram 179 illustrating a top view of an exemplary pultruded/extruded mounting component with internal support component of FIG. 11. FIG. 19B also illustrates a vertical mounting component portion 184 that has shape 26 but a radius and diameter smaller than that illustrated in FIG. 19A.

FIG. 20A is a block diagram illustrating a side view 186 the exemplary pultruded mounting component 180. FIG. 20A illustrates the mounting component with shape 26 to attaching the pullwound pultruded 53 components described above also used for lighting structures 130, 141.

FIG. 20B is a block diagram of illustrating an perspective view an exemplary pultruded/extruded mounting component 187 with a configurable removable vertical vertical mounting component portion 184.

FIG. 21 is a block diagram of a digital photograph 190 illustrating a perspective view 182 of the mounting component 180 attached to an uneven bedrock surface and a pultruded utility structure 53, utility support structure 58, 60, 76, 80, 88 and/or lighting structure 130, 141. In the photograph, bolts are used in pre-drilled holes to attach a pullwound pultruded structure to the vertical mounting component portion 184 of the mounting component 180.

The mounting component 180 can be installed temporarily or permanently install on virtually any surface at virtually any angle to mount pultruded and/or extruded structures 10, 52, 54, 78, 86, 130, 141 The mounting component 180 includes a horizontal mounting portion 182 and a vertical mounting portion 184.

In one embodiment, the horizontal mounting portion 182 includes a flat plate with precut holes for securing mounting means such as screws, bolts, etc. Extending upward from a center of the horizontal mounting portion 182 is a vertical mounting component portion 184 with a pre-determined shape and height.

The pre-determined height 188 (FIG. 20) of the vertical mounting component portion 184 is selected depending upon application and usage. In one exemplary embodiment, the pre-determined height 188 is about three feet to about six to about ten feet in height, depending on the type of structure being mounted. For example the utility support structures of FIGS. 6-9 may require a longer pre-determined height (e.g. about six feet to about ten feet, etc.) than the a utility pole 53 or lighting structure 130, 141 which typically requires a shorter pre-determined height (e.g., about three feet, etc.).

In one embodiment, the vertical mounting component portion 184 includes shape 26 (FIG. 3) with a third radius and a third diameter smaller than the first radius and the first diameter for shape 26 (FIG. 4). The smaller radius and diameter is used for sliding the vertical mounting component 184 into and attaching to an inner surface of the vertical pullwound pultruded cylindrical component 53. That is, the pullwound pultruded cylindrical component 53, etc. is slide over the top of a smaller radius and diameter vertical mounting component portion 184.

In another embodiment, the vertical mounting component portion 184 includes shape 26 (FIG. 3) for a hollow cylindrical pullwound pultruded component 53 with a thicker wall thickness. This provides additional support for the vertical mounting component portion 184 and for connecting other components to the vertical mounting component portion.

The vertical mounting component portion 194 is also specifically sized and shaped to fit exactly inside the hollow portions of the cylindrical pultruded/extruded structures 12, 53. In one embodiment, the vertical mounting component portion 184 includes plural pre-drilled holes for attaching the pultruded/extruded structures 12, 53. In such an embodiment, the pre-drilled holes are in alignment with holes pre-drilled in the pultruded/extruded structures 12, 53. The vertical mounting component portion 184 provides additional tensile, flexural and compressive strength the pultruded/extruded structures 10, 52, 54, 78, 86, 130, 141.

FIGS. 19 and 20 illustrated the vertical mounting component portion 184 with a pre-determined shape 26 (FIG. 3) for a pullwound pultruded structure 53. In such an embodiment, the radius and diameter for the vertical mounting component are slightly smaller than a radius and a diameter used for the pullwound pultruded structure 53 so when the pullwound pultruded structure 53 is placed over the vertical mounting component 184 is interlocks and prevents the pullwound pultruded structure 53 from rotating on the vertical mounting component.

In one embodiment, the vertical mounting component portion 184 comprises a hollow pullwound, pultruded cylindrical structure 53 In another embodiment, the vertical mounting component comprises a hollow cylindrical structure comprising materials other than the pullwound, pultruded material (e.g., steel, metal, plastic, hard rubber, composite material, etc.). However, such materials would still comprise shape 26 (FIG. 3) for interlocking a pullwound, pultruded cylindrical component 53. However, the present invention is not limited to these embodiment and other embodiments can be used to practice the invention.

In another embodiment 179, the vertical mounting component portion 184 comprises a hollow pullwound, pultruded cylindrical structure 53, with an internal support component 94 (FIG. 19B). The internal support structure 94 provides additional lateral support (i.e., support for sideways movement) and medial (i.e., support for middle movement) support for the vertical mounting component portion 184). However, the present invention is not limited to this embodiment and other embodiments can be used to practice the invention.

In another embodiment, the vertical mounting component 184 comprises a solid pullwound, pultruded cylindrical structure. In another embodiment, the vertical mounting component comprises a hollow and/or solid component with pre-determined shape 26 (FIG. 3) comprising steel, other metal, plastic, hard rubber, composite material and/or materials other than the pullwound pultruded materials. However, the present invention is not limited to these embodiment and other embodiments can be used to practice the invention.

In another embodiment, the vertical mounting component 184 includes a pre-determined size and shape 15 for an extruded structure 12 of shape 15 (FIG. 2).

In another embodiment, the pre-determined size and shape for the vertical mounting component portion 184 is a smooth hollow column. In such an embodiment, the smooth hollow and/or solid column includes a pre-determined size and shape and radius and diameter that is used as a universal vertical mounting component portion 184 for both pultruded structures 53 and extruded structures 12.

In one embodiment, the vertical mounting component portion 184 is attached to the horizontal mounting component 182 portion during manufacture and is permanently attached thereto. (e.g., FIG. 20A).

In another embodiment, the vertical mounting component 184 portion is not attached to the horizontal mounting component portion 182. (e.g., FIG. 20B) The vertical mounting component portion 184 includes a configurable, removable vertical mounting component portion 184. The vertical mounting component portion 184 with a first pre-determined length (e.g., about three feet for a utility pole 53, lighting component 130, 141, etc.) can be removed and replaced with a vertical mounting component portion comprising a second pre-determined length 188' (e.g., about six to about ten feet, for a utility support structure 54, 72, 78, 86 component, etc.). In such an embodiment, the vertical mounting component portion 184 includes an additional attachment means 189 such as a bottom end that is threaded, etc. In such an embodiment, the horizontal component 182 also includes additional receiving means 191, such another threaded mounting component 191 for accepting the threaded component for the threaded vertical mounting component 184.

In another embodiment, the attachment means and receiving means including a snap-lock, compression, bolt-washer, etc.

In another embodiment, the vertical mounting component portion 184 includes a threaded end and the horizontal mounting component portion 186 includes a hole and a threaded nut component 193. the threaded vertical mounting component portion 184 is placed into the hole of the horizontal mounting component 182 and extends below its surface. The threaded mounting component portion 184 is attached to the horizontal mounting component portion 182 by tightening the threaded nut 193 component up to a bottom surface of an underside of the surface of the horizontal mounting component portion 184.

In another embodiment, one or more mounting brackets 195 (only one illustrated in FIG. 20B) are mounted to the horizontal mounting portion 182 to engage the configurable, removable vertical mounting portion 184. In such an embodiment, bolts, screws, etc. are used in the one more mounting brackets to secure the configurable, removable mounting portion 184 to the horizontal mounting portion 182. In such an embodiment, the one or more mounting brackets 195 are specifically sized and shaped to fit into depressions of the shape 26 of the vertical mounting component portion 184 (i.e., attach to surfaces of the shape 26) so they do not interfere with a pullturded pullwound structure 53, etc. and/or lighting structure 130, 141 component placed over the top of the vertical mounting component portion 184.

However, the present invention is not limited to the mounting described and other types of mounting means and receiving means can also be used to practice the invention.

In another an embodiment, the vertical mounting component portion 184 includes one or more additional horizontal components (e.g., flanges, etc.) at a bottom end for stability. The one or more additional horizontal components include plural openings for mounting to the horizontal mounting component portion 182. The horizontal mounting component portion 182 includes an opening specifically sized and shaped for engaging the vertical mounting component portion 184. In such an embodiment, the vertical mounting component potion 184 is first placed on the mounting surface, and the horizontal mounting component portion 182 is placed over the vertical mounting component portion 166 via the opening in the horizontal mounting component portion 182 engaging it and is attached thereto with one or more mounting means (e.g. a screw, bolt, etc.). However, the present invention is not limited to the mounting described and other types of mounting can also be used to practice the invention.

In one embodiment, the horizontal mounting component portion 182 is a metal plate. In one exemplary embodiment, the metal plate includes a steel plate. In another embodiment, the horizontal mounting component portion 182 includes a non-metal plate comprising, a composite material, a pullwound pultruded material, a pulturded material an extruded material, etc. However, the present invention is not limited to such an embodiment and other materials and other embodiments can also be used to practice the invention.

In one exemplary embodiment, the horizontal mounting component portion 182 includes a steel base plate that is secured to concrete, sidewalks, asphalt, brick, bedrock or any surface using a mounting means (e.g., galvanized anchor bolts, washers and nuts, etc.)

In such an exemplary embodiment, the vertical mounting component portion 184 also includes a steel tubular column of a pre-determined height and specifically sized and shaped for pultruded/extruded structures 10, 52, 78, 86, 130, 141, etc. In another embodiment, the vertical mounting component portion 184 includes a non-metal column comprising, a composite material, a pultruded material, an extruded material, etc. However, the present invention is not limited to such an embodiment and other materials and other embodiments can also be used to practice the invention.

The methods and system described herein discuss pultruded and/or extruded lighting, support and climbing structures. The lighting structures comprise plural pullwound pultruded cylindrical structures and a mounting support structure. The lighting structures also include plural types of climbing components.

It should be understood that the processes, methods and system described herein are not related or limited to any particular type of component unless indicated otherwise. Various combinations of general purpose, specialized or equivalent components combinations thereof may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer or equivalent elements may be used in the block diagrams.

The claims should not be read as limited to the elements described unless stated to that effect. In addition, use of the term "means" in any claim is intended to invoke 35 U.S.C. §112, and any claim without the word "means" is not so intended.

Therefore, all embodiments that come within the scope and spirit of the following claims and equivalents thereto are claimed as the invention.

I claim:

1. A pultruded pullwound lighting apparatus, comprising in combination:

a vertical pullwound pultruded cylindrical means with a pre-determined inner and outer shape and first radius and first diameter for providing vertical support for the lighting apparatus and allowing the lighting apparatus to be attached to a surface, wherein the pullwound pultruded cylindrical means includes longitudinal reinforcements with a plurality of helical-wound layers, the plurality of helical-wound layers and pre-determined inner and outer shape providing maximum tensile strength, torsional strength and hoop strength and wherein the vertical pullwound pultruded cylindrical means is connected to a horizontal pullwound pultruded cylindrical means;

the horizontal pullwound pultruded cylindrical means with the same pre-determined inner and outer shape and a second radius and second diameter for providing horizontal support for the lighting apparatus connected to a pullwound pultruded support frame means and to a lighting means;

the pullwound pultruded support frame means for providing horizontal and vertical support for the lighting means and for connecting the horizontal pullwound pultruded cylindrical means to the vertical pullwound pultruded cylindrical means;

the lighting means for providing a light source to a selected area of the surface;

a mounting component means with a horizontal mounting component portion for mounting the vertical pullwound pultruded cylindrical means to the surface and connected to a vertical mounting component portion including a pullwound pultruded cylindrical means with the same pre-determined inner and outer shape and a third radius and a third diameter for mounting the vertical pullwound pultruded cylindrical means to the mounting component means and for proving additional vertical support for the pultruded pullwound lighting apparatus.

2. The apparatus of claim 1 wherein the vertical pullwound pultruded cylindrical means, the horizontal pullwound pultruded cylindrical means and the vertical mounting component portion include a hollow cylindrical structure comprising:

a repeating pattern of a plurality of alternating protruding components and intruding components forming an external surface and internal surface of the hollow cylindrical structure, wherein the repeating pattern of the plurality of alternating protruding components and intruding components of the hollow cylindrical structure provide tensile strength, torsional strength and hoop strength to the hollow cylindrical structure and wherein a shape created by the repeating pattern of the plurality of alternating protruding components and intruding components provides an optimal wind shear resistance for the hollow cylindrical structure distributing wind forces down along a length of the structure;

the external surface including the plurality of protruding components integrally connected to the plurality of intruding components with a plurality of curved connection components, wherein an individual protruding component includes two individual curved connection components connecting the individual protruding component to two individual intruding components and wherein the two individual curved connection components form an integral portion of both the individual protruding component and an integral portion of the two individual intruding components;

the internal surface including the plurality of intruding components integrally connected to the plurality of protruding components with the plurality of curved connection components, wherein an individual intruding component includes two other individual curved connection components for connecting the individual intruding component to two individual protruding components and wherein the two other individual curved connection components form another integral portion of both the individual intruding component and another integral portion of the two other individual protruding components;

the plurality of curved connection components each including a pre-determined curved connection component radius with two separate curved connection component outer radius portions forming two separate integral outer portions of an individual protruding component and two separate curved connection component inner radius portions forming two separate integral inner portions of an individual intruding component;

a pre-determined hollow cylindrical structure inner radius from a center point to an inner portion of the internal surface; and a pre-determined hollow cylindrical structure outer radius from the center point to an outer portion the external surface, wherein the difference between the pre-determined hollow cylindrical structure inner radius and pre-determined hollow cylindrical structure outer radius determines a thickness of the hollow cylindrical structure, and wherein the hollow cylindrical structure includes a pre-determined length.

3. The apparatus of claim 1 further comprising:

a plurality of attachable/detachable climbing support means with plurality of receiving receptacles for receiving a plurality of attachable/detachable climbing means for allowing a utility technician to safely climb the vertical pullwound pultruded cylindrical means of the pultruded lighting apparatus; and a plurality of attachable/detachable climbing means with one or more receiving receptacles for receiving a portion of the attachable/detachable climbing support means, for attaching to the attachable/detachable climbing support means, for receiving one or more protrusions protruding from attachable/detachable climbing support means and for providing a plurality of climbing components for safely climbing the attachable/detachable climbing support means.

4. The apparatus of claim 3 wherein the attachable/detachable climbing support means includes a pultruded material, a pullwound pultruded material, an extruded material, a metal, plastic, rubber, wood, or composite material.

5. The apparatus of claim 3 wherein the plurality of attachable/detachable climbing means include a plurality of attachable/detachable foot/hand pegs used with a plurality primary attachment components with one or more protrusions protruding there from for attaching the plurality of attachable/detachable foot/hand pegs to the attachable/detachable climbing support means.

6. The apparatus of claim 5 wherein an individual primary attachment component includes one or more protrusions for engaging an individual receiving receptacle on an individual foot/hand peg, wherein the individual primary attachment component is temporarily inserted into one of the plurality of receiving receptacles on the attachable/detachable climbing support means or is permanently attached with an attachment means to a selected portion of the pre-determined outer shape of the external surface of vertical pullwound pultruded cylindrical means.

7. The apparatus of claim 3 wherein the attachable/detachable climbing support means includes the pre-determined inner and outer shape for attaching to an external surface of vertical pullwound pultruded cylindrical means and a radius and a diameter larger than the first diameter of the vertical pullwound pultruded cylindrical means for securely attaching to an outer surface of the vertical pullwound pultruded cylindrical means.

8. The apparatus of claim 5 wherein an individual attachable/detachable foot/hand pegs from the plurality of attachable/detachable foot/hand pegs includes a first receiving receptacle for temporarily attaching the individual attachable/detachable foot/hand peg directly to one of the plurality of receiving receptacles on attachable/detachable climbing support means and a second receiving receptacle for temporarily attaching the individual attachable/detachable foot/hand peg to the one or more protrusions protruding from a primary attachment component attached to the attachable/detachable climbing support means.

9. The apparatus of claim 1 wherein the lighting means includes a wired-powered, a solar powered, or a battery powered lighting means.

10. The apparatus of claim 1 further comprising:

the pullwound pultruded support frame means including one or more metal, other plastic or composite material component.

11. The apparatus of claim 1 further comprising:

integral copper wires embedded into one or more surfaces of the vertical pullwound pultruded cylindrical means or horizontal pullwound pultruded cylindrical means or included in a hollow component therein that allow the apparatus to be used an antenna for wireless or other types of communications.

12. The apparatus of claim 1 further comprising:

the vertical pullwound pultruded cylindrical means or horizontal pullwound pultruded cylindrical means comprise a hollow pullwound pultruded cylindrical structure with an internal support structure for providing additional tensional, torsional strength and hoop strength.

13. The apparatus of claim 1 wherein the vertical mounting component portion of the mounting component means includes the third radius and third diameter that is smaller than the first diameter of the vertical pullwound pultruded cylindrical means for securely sliding into and attaching to an inner surface of the vertical pullwound pultruded cylindrical means.

14. The apparatus of claim 1 wherein the vertical mounting component portion of the mounting component means includes a solid cylindrical mounting component or a hollow cylindrical mounting component.

15. The apparatus of claim 1 wherein the vertical mounting component portion of the mounting component means comprises a material other than a pullwound pultruded material.

16. The apparatus of claim 15 wherein the vertical mounting component portion of the mounting component means comprising a steel, metal other than steel, plastic rubber or composite material and including same pre-determined inner and outer shape and the third radius and the third diameter.

17. The apparatus of claim 1 further comprising:

the vertical mounting component portion of the mounting component means comprising a hollow pullwound pultruded cylindrical structure with an internal support structure for providing additional tensional, torsional strength and hoop strength.

18. The apparatus of claim 1 further comprising:

the mounting component means comprising a configurable, removable vertical mounting component portion wherein the vertical mounting component portion of a first pre-determined length can be removed and replaced with a vertical mounting component portion comprising a second pre-determined length.

19. A pultruded pullwound lighting apparatus, comprising in combination:

a hollow configurable, removable vertical pullwound pultruded cylindrical means with a pre-determined inner and outer shape and first radius and first diameter for providing vertical support for the lighting apparatus and allowing the lighting apparatus to be attached to a surface, wherein the pullwound pultruded cylindrical means includes longitudinal reinforcements with a plurality of helical-wound layers, the plurality of helical-wound layers and pre-determined inner and outer shape providing maximum tensile strength, torsional strength and hoop strength and wherein the vertical pullwound pultruded cylindrical means is connected to a hollow horizontal pullwound pultruded cylindrical means;

the hollow horizontal pullwound pultruded cylindrical means with the same pre-determined inner and outer shape and a second radius and second diameter for providing horizontal support for the lighting apparatus connected to a pullwound pultruded support frame means and to a lighting means;

the pullwound pultruded support frame means for providing horizontal and vertical support for the lighting means and for connecting the horizontal pullwound pultruded cylindrical means to the vertical pullwound pultruded cylindrical means;

the lighting means for providing a light source to a selected area of the surface;

a mounting component means with a horizontal mounting component portion for mounting the vertical pullwound pultruded cylindrical means to the surface and connected to a removable configurable vertical mounting component portion including another hollow pullwound pultruded cylindrical means with the same pre-determined inner and outer shape and a third radius and a third diameter smaller than the first radius and first diameter for mounting the vertical pullwound pultruded cylindrical means to the mounting component means by sliding the a hollow vertical pullwound pultruded cylindrical means over the vertical mounting component portion and for proving additional vertical support for the pultruded pullwound lighting apparatus.

20. The apparatus of claim 19 wherein the pullwound pultruded cylindrical means comprise a hollow pullwound pultruded cylindrical structure with an internal support structure for providing additional tensional, torsional strength and hoop strength.

* * * * *